US006007300A

United States Patent [19]

Saeki et al.

[11] Patent Number: 6,007,300

[45] Date of Patent: Dec. 28, 1999

[54] CENTRIFUGAL MULTIBLADE FAN

[75] Inventors: Naofumi Saeki, Ibaraki; Manabu Uomoto, Gunma; Toshio Ohashi, Tochigi; Kaoru Kamiyama, Tochigi, all of Japan

[73] Assignee: Calsonic Corporation, Tokyo, Japan

[21] Appl. No.: 08/857,507

[22] Filed: May 16, 1997

[30] Foreign Application Priority Data

| | | | |
|---|---|---|---|
| May 17, 1996 | [JP] | Japan | 8-123547 |
| Dec. 2, 1996 | [JP] | Japan | 8-321650 |
| Mar. 7, 1997 | [JP] | Japan | 9-053310 |

[51] Int. Cl.[6] ..... F04D 29/18

[52] U.S. Cl. ..... 416/178; 416/183; 416/186 R; 416/187; 416/223 B; 416/231 B

[58] Field of Search ..... 416/178, 183, 416/185, 186 R, 187, 233 B, 231 R, 231 B, 243

[56] References Cited

U.S. PATENT DOCUMENTS

| | | | |
|---|---|---|---|
| 45,755 | 1/1865 | Sandford | 416/186 R |
| 2,266,180 | 12/1941 | Emerick | 416/186 R |
| 3,140,042 | 7/1964 | Fujii | 416/186 R |
| 3,394,876 | 7/1968 | Eck . | |

FOREIGN PATENT DOCUMENTS

| | | | |
|---|---|---|---|
| 453894 | 2/1913 | France | 416/231 R |
| 443 163 | 4/1927 | Germany . | |
| 1 047 980 | 12/1958 | Germany . | |
| 28 50 358 | 5/1980 | Germany . | |
| 50-76407 | 7/1975 | Japan . | |
| 50-76408 | 7/1975 | Japan . | |
| 52-2612 | 1/1977 | Japan . | |
| 56-052599 | 5/1981 | Japan . | |
| 58-94898 | 6/1983 | Japan . | |
| 60-60299 | 4/1985 | Japan . | |
| 60-132098 | 7/1985 | Japan . | |
| 61-065095 | 4/1986 | Japan . | |
| 62-291498 | 12/1987 | Japan . | |
| 63-97899 | 4/1988 | Japan . | |
| 4-203395 | 7/1992 | Japan . | |
| 5-296194 | 11/1993 | Japan . | |
| 5-87295 | 11/1993 | Japan . | |
| 94-15295 | 7/1994 | Rep. of Korea . | |
| 754055 | 8/1956 | United Kingdom | 416/231 R |
| 840447 | 7/1960 | United Kingdom | 416/187 |
| 894893 | 4/1962 | United Kingdom | 416/183 |

OTHER PUBLICATIONS

Patent Abstracts of Japan, Matsushita Seiko Co., Ltd., vol. 010, No. 231, (M506), Aug. 12, 1986.

*Primary Examiner*—Christopher Verdier
*Attorney, Agent, or Firm*—Foley & Lardner

[57] ABSTRACT

A centrifugal multiblade fan comprises a plurality of curved blades which are circularly arranged about a common rotation axis at evenly spaced intervals defining a curved air flow passage between every neighboring blades. Each curved blade has concave front and convex rear surfaces which extend longitudinally in parallel with the rotation axis. A lower annular end plate is provided for putting thereon lower ends of the circularly arranged blades. A radially outside part of each curved blade has a radius of curvature which is greater than that of a radially inside part of the blade. A slit extends longitudinally parallel with the rotation axis at a radially inside portion of each blade.

38 Claims, 24 Drawing Sheets

CENTRIFUGAL MULTIBLADE FAN

BACKGROUND OF THE INVENTION

1. Field of the Invention

The present invention relates in general to centrifugal multiblade fans constructed of plastics, and more particularly to centrifugal multiblade fans for an automotive air conditioning device. More specifically, the present invention is concerned with the centrifugal multiblade fans of a type which is installed in an upstream section of an air duct of the automotive air conditioning device to generate, upon rotation of the fan, an air flow in the air duct toward the passenger cabin of the vehicle.

2. Description of the Prior Art

In automotive air conditioning devices, there is usually employed a centrifugal multiblade fan which is installed in an upstream section of an air duct of the air conditioning device. The fan is driven by an electric motor. That is, upon operation of the motor, the fan is rotated to generate an air flow in the air duct from the outdoor or indoor of an associated motor vehicle toward the passenger cabin of the vehicle. During the flow in the duct, the air passes through an evaporator and/or heater core to adjust temperature thereof to a desired degree. The air thus adjusted in temperature is led into the passenger cabin of the vehicle through air blow openings provided at a downstream end of the air duct.

Some of conventional fans of the centrifugal multiblade type are shown in Japanese Patent First Provisional Publications 63-97899 and 60-60299, two of which are schematically shown in FIGS. 33 and 34 of the accompanying drawings, respectively.

As shown, each fan 1*a* or 1*b* comprises a plurality of curved blades 2 which are circularly arranged about a common rotation axis at evenly spaced intervals defining an air flow passage 3 between every neighboring curved blades 2. As is seen from FIG. 35, each curved blade 2 of the fan 1*a* or 1*b* has a generally semi-cylindrical shape, that is, the shape having an arcuate cross section. That is, each curved blade 2 has concave front (or leading) and convex rear (or trailing) surfaces 4 and 5 which extend longitudinally in parallel with the rotation axis. Accordingly, each air flow passage 3 curves as it extends radially.

The terms "front and rear" are to be understood with respect to the direction "α" in which the fan 1*a* or 1*b* rotates under operation of the air conditioning device. When, upon energization of the electric motor, the fan 1*a* or 1*b* is rotated in the direction of the arrow "α", air in each air flow passage 3 is forced to move radially outward due to a centrifugal force generated therein. As a result, air is forced to flow radially outward from the inside of the fan 1*a* or 1*b* toward the outside through the air flow passages 3.

As is known, the fans of the above-mentioned centrifugal multiblade type produce less operation noise than axial fans such as propeller fans. However, sometimes, even the centrifugal multiblade fans fail to provide users with full satisfaction. That is, when the air conditioning device is in an inner air circulation mode wherein the air blown to the interior of the vehicle is fed from the interior of the vehicle, the noise caused by the fan becomes noticeable, which makes the passengers uncomfortable.

In addition to the above-mentioned fans, other conventional centrifugal multiblade fans have been proposed, which are shown in Japanese Patent First Provisional Publications 62-291498 and 4-203395, and Japanese Utility Model First Provisional Publications 50-76407, 50-76408, 52-2612, 58-94898 and 5-87295. In the fans of these publications, a slit or small opening is formed in each curved blade to improve the performance of the fans. However, even the fans of these publications have failed to provide users with a satisfaction in noise reduction performance, particularly in the inner air circulation mode of the air conditioning device.

SUMMARY OF COMPUTER SIMULATION TESTS

In order to accomplish the present invention, the applicants have carried out various computer simulation tests regarding the structure and arrangement of the curved blades 2 of the fan 1*a* or 1*b*. With the tests, the applicants have found the following facts.

That is, as is seen from FIG. 36, when the fan 1*a* or 1*b* is rotated at a high speed, there is inevitably produced a negative pressure area 6 in each air flow passage 3 at a position facing a radially inside part of the convex rear surface 5. Due to presence of this negative pressure area 6, the air in the air flow passage 3 is forced to flow radially outward in and along a limited way which is cross-hatched in the drawing. That is, due to presence of the negative pressure area 6, the way for the air is narrowed at that area 6 and thus, not only air flow velocity at such throat area is remarkably increased, but also vortexes are produced in the negative pressure area 6. As is known, these phenomena bring about a large operation loss of the fan 1*a* or 1*b*. According to the simulation tests, the applicants have revealed that the reason for the negative pressure area 6 is a lack of momentum (or energy) possessed by the air which is about to flow in the area 6. That is, as compared with a circumferential velocity of each curved blade 2, the velocity of the air flowing radially outward in that area 6 is small and thus the air flow in the passage 3 becomes separated from the convex rear surface 5.

In view of the above-mentioned facts, the applicants have invented a solution (1X) which is depicted by FIG. 37. As is seen from this drawing, in the solution (1x), the radially inside part of each curved blade 2 has a greater curvature (i.e., more bend) than that of the radially outside part of the curved blade 2. In other words, the radius of curvature of the inside part is smaller than that of the outside part. That is, in the measure (1X), each curved blade 2 has an arcuate cross section which projects rearward at a portion corresponding to the negative pressure area 6 of FIG. 36. With this solution, the undesired negative pressure area 6 is eliminated or at least minimized, and thus drawbacks caused by such negative pressure area 6 are eliminated.

SUMMARY OF THE INVENTION

The present invention is provided by taking the above-mentioned facts into consideration.

Similar to the above-mentioned conventional centrifugal multiblade fan, a fan of the present invention comprises a plurality of curved blades which are circularly arranged about a common rotation axis at evenly spaced intervals defining an air flow passage between every neighboring curved blades. Each curved blade has a generally semi-cylindrical shape, that is, the shape having an arcuate cross section. That is, each curved blade has concave front (or leading) and convex rear (or trailing) surfaces which extend longitudinally in parallel with the rotation axis. The air flow passage thus curves as it extends radially.

In addition to the above, each curved blade of the centrifugal multiblade fan of the present invention has the following feature.

That is, each curved blade comprises a radially outside part having a larger radius of curvature and a radially inside part having a smaller radius of curvature which are united through a smoothly curved portion.

Besides, each curved blade of the fan of the present invention has a slit which fulfills the following requirements.

(1) The slit is formed at the radially inside part of the curved blade, and extends in parallel with the rotation axis the fan.

(2) The thickness of the slit is smaller than ⅕ the width of a part of the air flow passage to which the slit is exposed.

(3) The slit curves radially outward as it extends in the curved blade from the concave front surface to the convex rear surface.

It is thus an object of the present invention to provide an improved centrifugal multi blade fan which is provided by taking the above-mentioned facts into consideration.

According to a first aspect of the present invention, there is provided a centrifugal multiblade fan which comprises a plurality of curved blades which are circularly arranged about a common rotation axis at evenly spaced intervals defining a curved air flow passage between every neighboring blades, each curved blade having concave front and convex rear surfaces which extend longitudinally in parallel with the rotation axis; and a lower annular end plate connected to one end of the circularly arranged blades, wherein a radially outside part of each curved blade has a radius of curvature which is greater than that of a radially inside part of the blade.

According to a second aspect of the present invention, there is provided a centrifugal multiblade fan which comprises a plurality of curved blades which are circularly arranged about a common rotation axis at evenly spaced intervals defining a curved air flow passage between every neighboring blades, each curved blade having concave front and convex rear surfaces which extend longitudinally in parallel with the rotation axis, a radially outside part of each curved blade having a radius of curvature which is greater than that of a radially inside part of the blade; means defining an axially extending slit in the radially inside part of each blade; and a lower annular end plate connected to a lower end of each circularly arranged blade, wherein each slit curves radially outward as it extends in the curved blade from the concave front surface to the convex rear surface, wherein the thickness of each slit increases gradually with increase of distance from the concave front surface, and wherein an inclination angle defined by an upper wall of the slit is greater than that of a lower wall of the slit.

According to a third aspect of the present invention, there is provided a centrifugal multiblade fan which comprises a plurality of curved blades which are circularly arranged about a common rotation axis at evenly spaced intervals defining a curved air flow passage between each pair of neighboring blades, each curved blade having concave front and convex rear surfaces which extend longitudinally in parallel with the rotation axis, a radially outside part of each curved blade having a radius of curvature which is greater than that of a radially inside part of the blade; means defining an axially extending slit in the radially inside part of each blade; an upper annular end plate to which upper ends of the circularly arranged blades are integrally connected; and a lower annular end plate to which lower ends of the circularly arranged blades are integrally connected.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
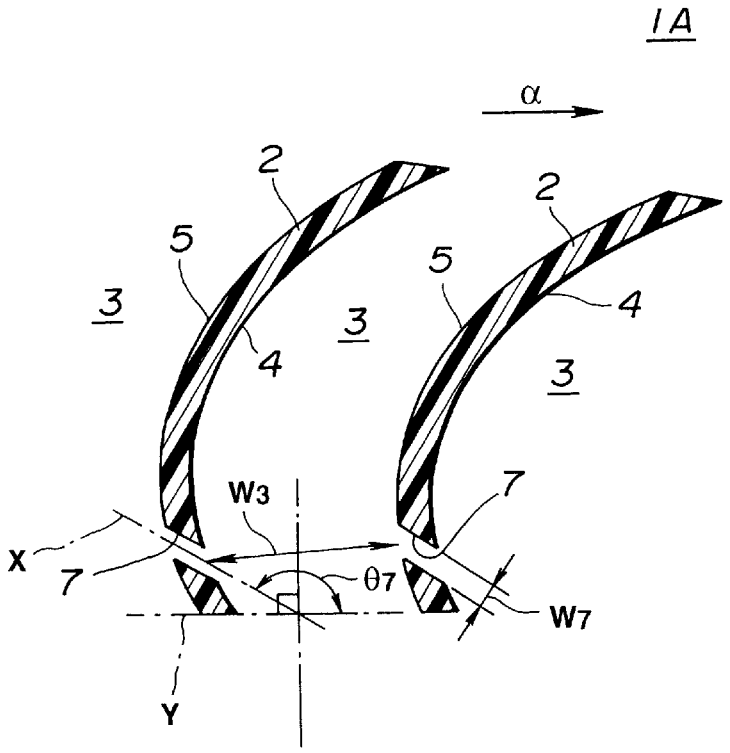
FIG. 1 is a partial sectional view of two curved blades employed in a centrifugal multiblade fan which is a first embodiment of the present invention, the view corresponding to the sectional view taken along the line I—I of FIG. 33.
Figure 2:
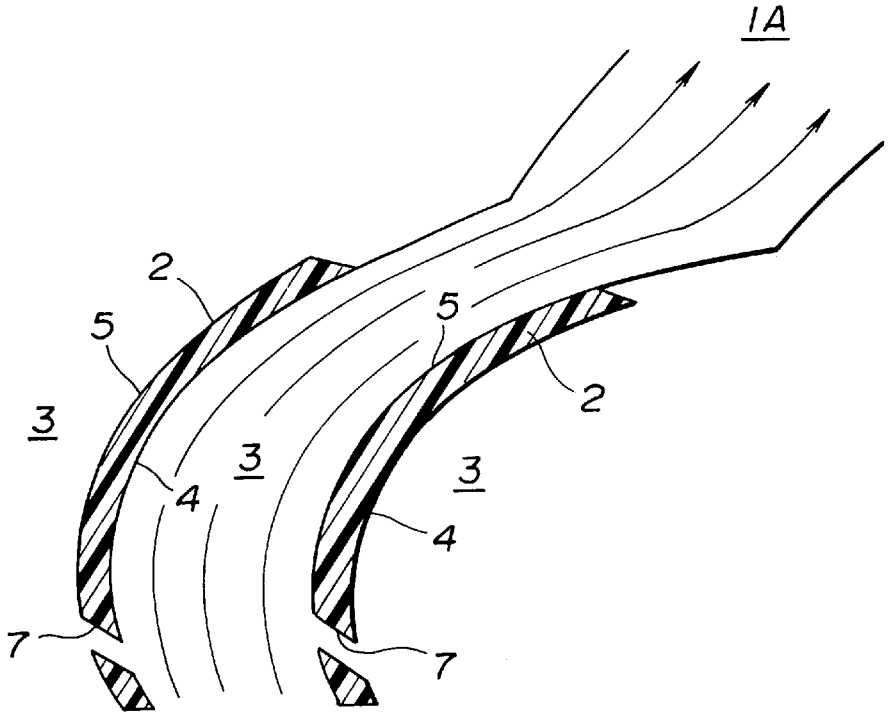
FIG. 2 is a view similar to FIG. 1, but showing a way in and along which air is forced to flow under rotation of the fan of the first embodiment.

Referring to FIGS. 1 and 2, there is partially shown a centrifugal multiblade fan 1A which is a first embodiment of the present invention.

Figure 33:
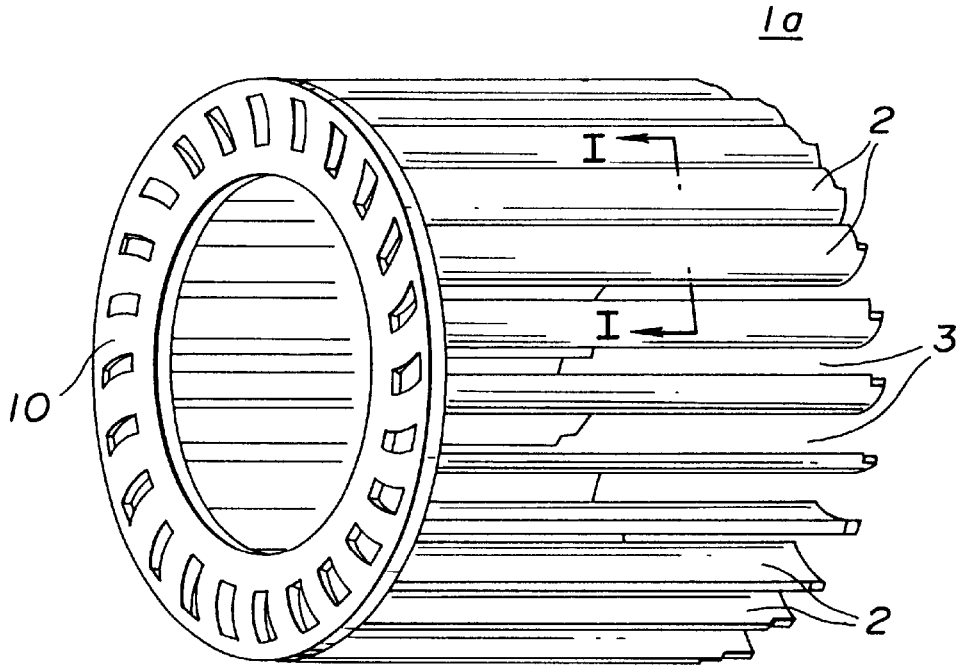
FIG.33 (PRIOR ART)
FIG. 33 is a partial perspective view of a conventional centrifugal multiblade fan for use in an automotive air conditioning device.
Figure 34:
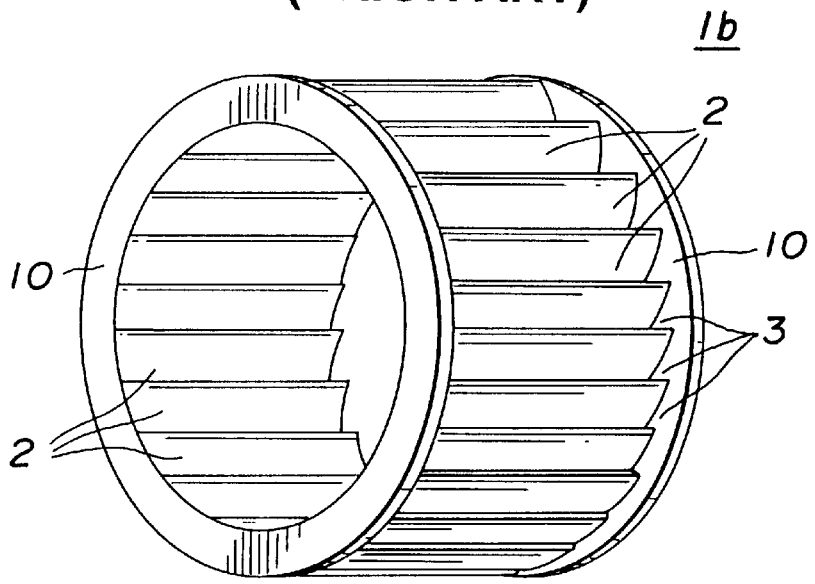
FIG.34 (PRIOR ART)
FIG. 34 is a perspective view of another conventional centrifugal multiblade for the automotive air conditioning device.

Similar to the above-mentioned conventional fans of FIGS. 33 and 34, the fan 1A of the first embodiment comprises a plurality of curved blades 2 which are circularly arranged about a common rotation axis at evenly spaced intervals defining an air flow passage 3 between every neighboring curved blades 2. Each curved blade 2 has a generally semi-cylindrical shape, that is, the shape having an arcuate cross section. That is, each curved blade 2 has concave front (or leading) 4 and convex rear (or trailing) 5 surfaces which extend longitudinally in parallel with the rotation axis. The air flow passage 3 thus curves as it extends radially.

Figure 36:
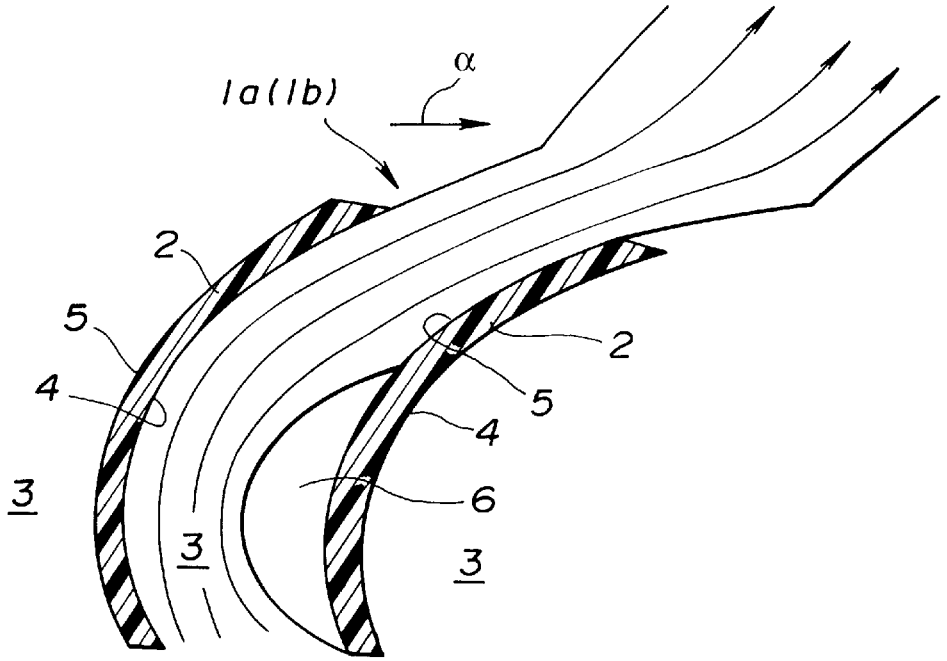
FIG.36 (PRIOR ART)
FIG. 36 is a view similar to FIG. 35, but showing a way in and along which air is forced to flow under rotation of the conventional fan.

As is seen from FIG. 1, each curved blade 2 is formed near an inward end with a slit 7 which has parallel upper and lower walls. That is, the slit 7 is formed at a radially inside part of the curved blade 2 with respect to a diameter of the fan 1A. In other words, the slit 7 is located at an upstream portion of the air flow passage 3 with respect to a direction in which air flows when the fan 1A is rotated in a normal direction "α". Due to the slit 7 at such position, a certain kinetic energy is applied to any air flowing along the convex rear surface 5 of the blade 2 during rotation of the fan 1A. With such energy, the kinetic energy of the outward air flow along the convex rear surface 5 is increased. That is, through the slit 7, air is blown into the negative pressure area 6 (see FIG. 36) to increase the kinetic energy of the air flow in such area 6. In other words, due to provision of the slit 7, undesired negative pressure area 6 is eliminated in this embodiment.

As is understood from FIG. 1, the thickness "W7" of the slit 7 is smaller than ⅕ of that of a part of the air flow passage 3 to which the slit 7 is exposed. That is, the following inequality is established in the first embodiment.

$$W7 \leqq W3/5 \quad (1)$$

If the thickness "W7" is too large, excessive air is blown into the negative pressure area 6 through the slit 7, which not only deteriorates the air driving efficiency of the fan 1A but also causes generation of noise. Preferably, the thickness "W7" of the slit 7 is larger than 1/20 of that of the part of the air flow passage 3 to which the slit 7 is exposed. That is, the following inequality is established in a preferable example of the first embodiment.

$$W7 \geqq W3/20 \quad (2)$$

As is understood from FIG. 1, each slit 7 curves radially outward as it extends in the curved blade 2 from the concave front surface 4 to the convex rear surface 5. That is, assuming an angle defined between an imaginary plane "X" evenly passing through the slit 7 and another imaginary plane "Y" that is tangent to an imaginary cylindrical surface coaxially extending around the rotation axis of the fan 1A is denoted by "$\theta_7$", the following inequality is established.

$$90° < \theta_7 < 180° \quad (3)$$

With this angle "$\theta_7$", elimination of the undesired negative pressure area 6 is assured.

Actually, the angle "$\theta_7$" is determined in accordance with the diameter of the fan 1A, the number of the curved blades 2 and the like. That is, in a fan employed in automotive air conditioning devices wherein the outer diameter of the fan is about 150 to about 170 mm, the axial length of the fan is about 70 to about 80 mm and the number of the curved blades 2 is about 30 to 50, the angle "$\theta_7$" is calculated from the following equation.

$$\theta_7 = \pi - \tan^{-1}(U/V) \quad (4)$$

wherein:

U: radial velocity of air led into the air flow passage 3.

V: rotation direction velocity of air flowing in the passage 3 near the slit 7.

In view of various correction factors, the angle "$\theta_7$" should be determined to about 100° to about 120°.

As is described hereinabove, in the centrifugal multiblade fan 1A of the invention, creation of the undesired negative pressure area 6 in each air flow passage 3 is eliminated or at least minimized. Accordingly, as is seen from FIG. 2, when the fan 1A is rotated at a high speed, there is produced, due to a centrifugal force, in each air flow passage 3 an air flow in a direction from a radially inside portion toward a radially outside portion. The air flow is pressed against the concave front surface 4 of each curved blade 2, and thus, part of the air flow is directed to a rear air flow passage 3 through the slit 7.

As has been mentioned hereinabove, each slit 7 is arranged to curve radially outward as it extends rearward in the curved blade 2. Accordingly, the air flow passing through the slit 7 can apply a certain kinetic energy to the air flowing in the rear air flow passage 3, and thus, the air flow in the rear air passage 3 is smoothly carried out.

As is described hereinabove, in the fan 1A of the invention, the outward air flow in each air flow passage 3 is smoothly carried out without leaving an undesired negative pressure area therein.

Figure 3:
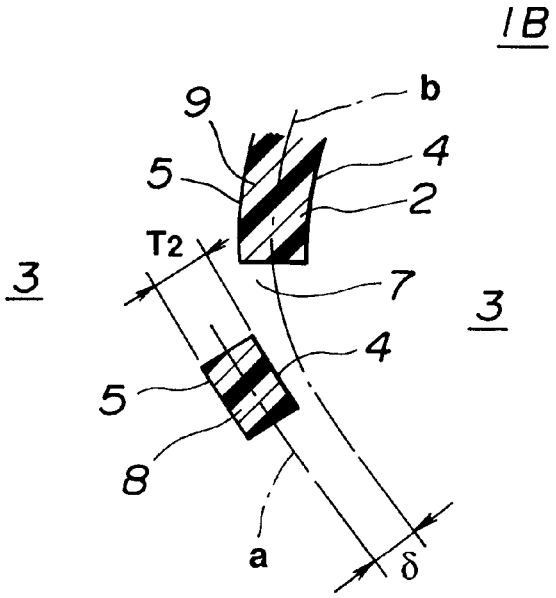
FIG. 3 is a partial sectional view of one of curved blades employed in a fan of a second embodiment.

Referring to FIG. 3, there is partially shown a centrifugal multiblade fan 1B which is a second embodiment of the present invention. In this embodiment 1B, a radially inside part 8 of each curved blade 2, that is, the part positioned inside relative to the slit 7, is displaced rearward by a certain distance "δ". The distance "δ" should be smaller than the thickness "T2" of the part 8. That is, the following inequality is established.

$$\delta \leqq T2 \quad (5)$$

Preferably, the distance "δ" is smaller than ½ of the thickness "T2" (that is, δ<T2/2). In a preferred example which is not shown in the drawing, a camber line "a" of the inside part 8 extends between the front and rear surfaces 4 and 5 of a radially outside part 9 of the blade 2 and, a camber line "b" of the outside part 9 extends between the front and rear surfaces 4 and 5 of the inside part 8.

Figure 4:
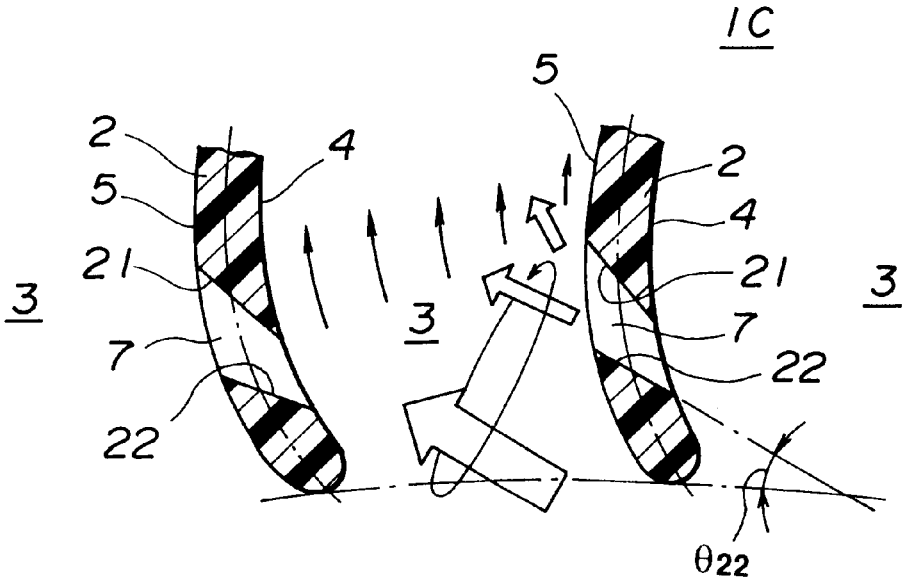
FIG. 4 is a view similar to FIG. 1, but showing a third embodiment of the present invention.

Referring to FIG. 4, there is partially shown a centrifugal multiblade fan 1C which is a third embodiment of the present invention. In this embodiment, the thickness of each slit 7 increases gradually with increase of distance from the front surface 4 of the blade 2. As shown, for achieving this, the inclination angle of the upper wall 21 of the slit 7 is made greater than that of the lower wall 22. With such slits 7, the undesired negative pressure area is eliminated. The reason of this elimination will be described in the following with reference to FIGS. 5A, 5B and 4.

Figure 5A:
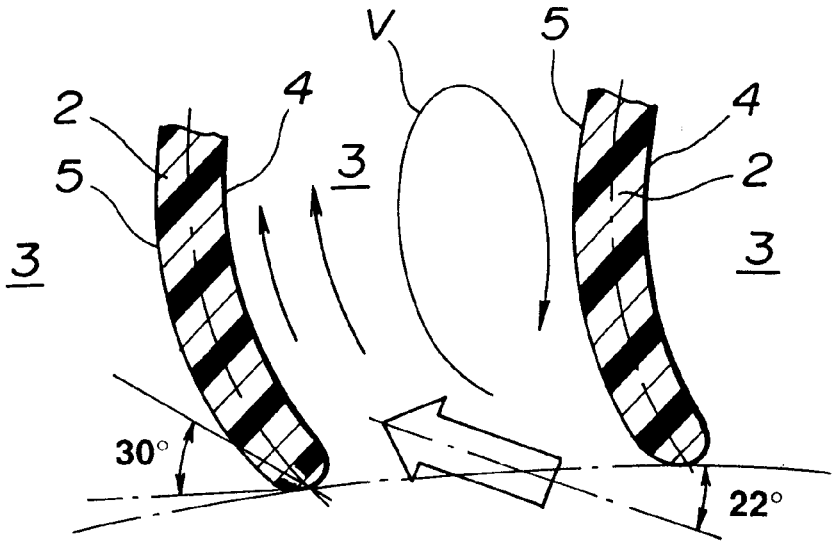
FIG.5A (PRIOR ART)
FIG. 5A is a view similar to FIG. 1, but showing a conventional centrifugal multiblade fan.
Figure 5B:
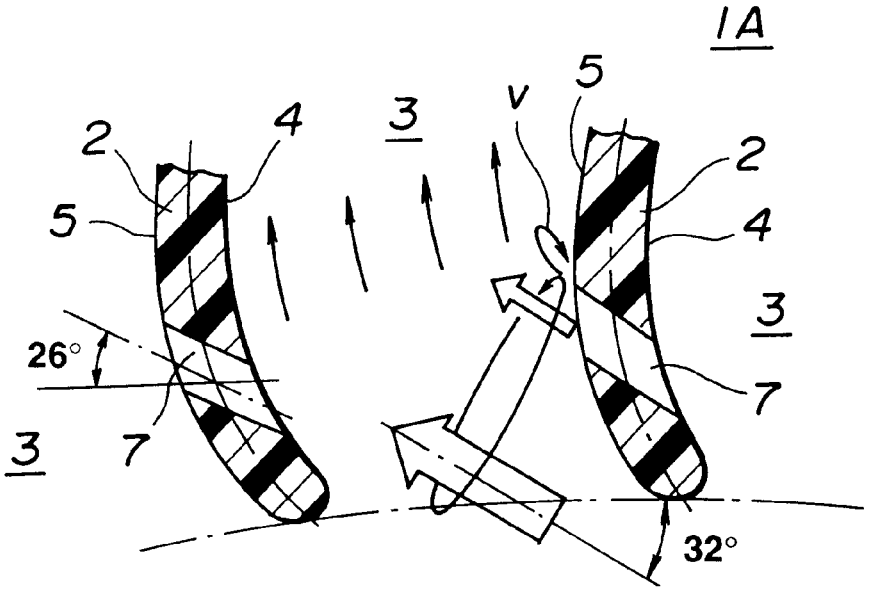
FIG. 5B is a view similar to FIG. 1, but showing the fan of the first embodiment.
Figure 35:
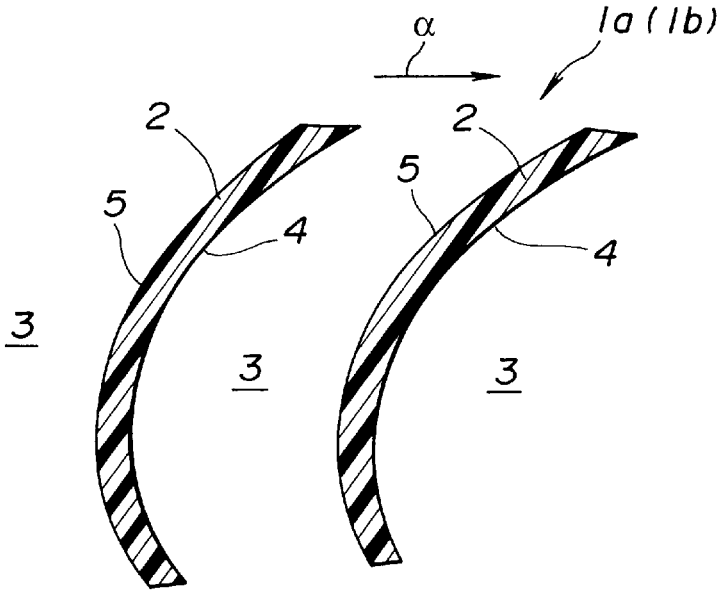
FIG.35 (PRIOR ART)
FIG. 35 is a sectional view of two curved blades employed in the conventional fan.

FIG. 5A shows radially inside portions of curved blades of a conventional centrifugal multiblade fan, such as the blades shown in FIG. 35, and FIG. 5B shows radially inside portions of curved blades of the centrifugal multiblade fan 1A of the above-mentioned first embodiment.

In the conventional fan of FIG. 5A, the inclination angle of each blade 2 relative to an inscribed cylindrical surface is 30°. In this case, under rotation of the fan, air is led into the air flaw passage 3 while defining an entry angle of about 22° relative to the inscribed cylindrical surface. Tests have revealed that such entry angle causes generation of marked vortexes "V" near the rear surface 5 of each blade 2. While, in the fan 1A of FIG. 5B wherein the angle defined between the imaginary plane "X" passing through the slit 7 and the inscribed cylindrical surface is 26°, the entry angle of the air led into the air flow passage 3 is about 32°. Tests have revealed that such entry angle and such arrangement of the slits 7 cause generation of only small vortexes "v" near the rear surface 5 of each blade 2. In fact, such small vortexes "v" tend to appear at a rear end of the upper wall of each slit 7.

In the third embodiment 1C of FIG. 4, the rear end of the upper wall 21 of the slit 7 is displaced radially outward for eliminating a portion where such small vortexes "v" tend to appear.

Figure 6:
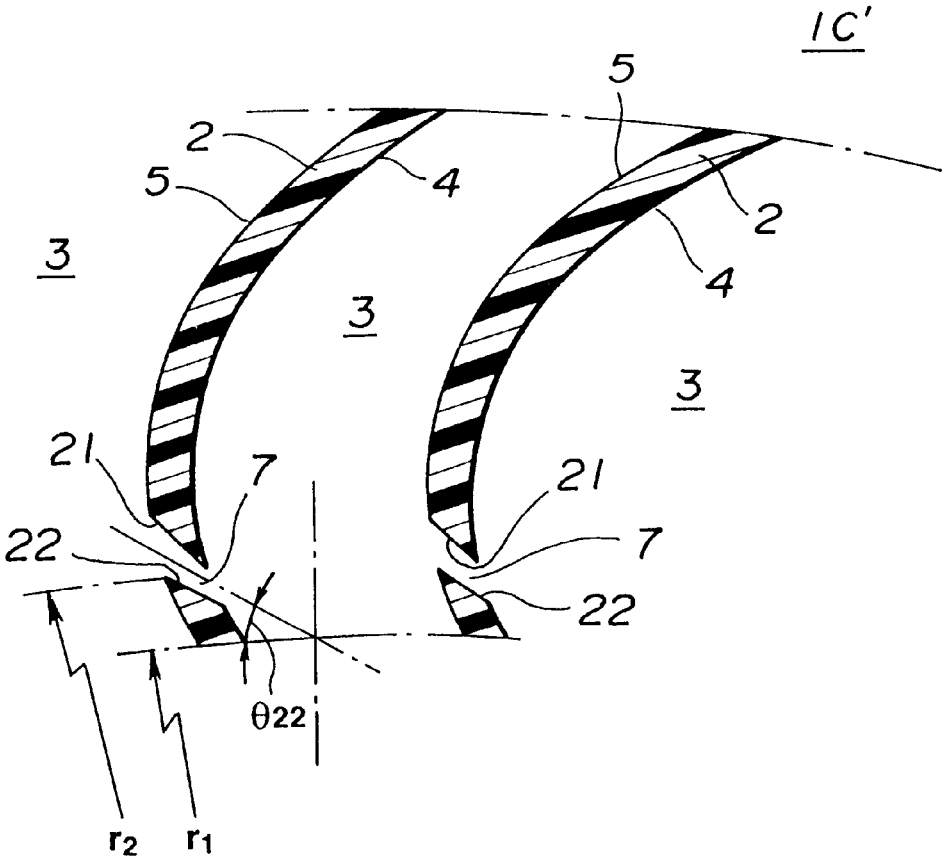
FIG. 6 is a view similar to FIG. 4, but showing a first preferred example of the third embodiment.

Referring to FIG. 6, there is shown a preferred example 1C' of the third embodiment. In this drawing, "$r_1$" is a radius of the inscribed cylindrical surface and "$r_2$" is a distance between the rotation axis of the fan and the outermost end of the lower wall 22 of each slit 7. In this preferred example 1C', the following inequality is established.

$$r_2/r_1 \leqq 1.08 \quad (6)$$

Furthermore, the angle $\theta_{22}$ defined between the lower wall 22 of each slit 7 and the inscribed cylindrical surface satisfies the following inequality in this example 1C'.

$$\theta_{22} \geqq \tan^{-1}(U/V) \quad (7)$$

wherein:

U: radial velocity of air led into the air flow passage 3.

V: rotation direction velocity of air flowing in the passage 3 near the slit 7.

Thus, when the fan 1C' is used in an automotive air conditioning device wherein "V" is about 15.27 m/s and "U" is about 3.75 m/s, the following inequality is established.

$$\theta_{22} \geqq 13.8° \quad (8)$$

Figure 7:
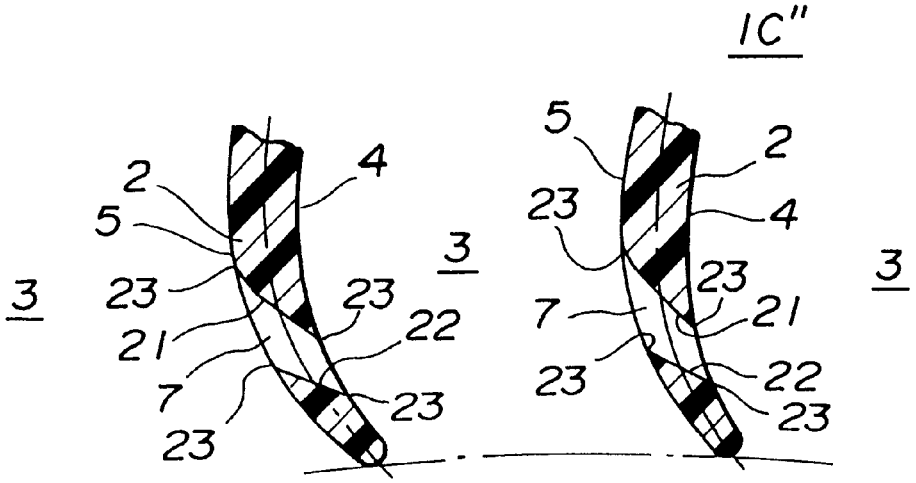
FIG. 7 is a view similar to FIG. 4, but showing a second preferred example of the third embodiment.

Referring to FIG. 7, there is shown another preferred example 1C" of the third embodiment. In this example 1C", the upper and lower walls 21 and 22 of each slit 7 are chamfered at their rear ends 23. If desired, the upper and lower walls 21 and 22 may be chamfered at their front ends. Furthermore, if desired, as is shown in the drawing, each blade 2 has a tapered inner end to allow a smooth air flow into the air flow passage 3 under rotation of the fan 1C".

Figure 8:
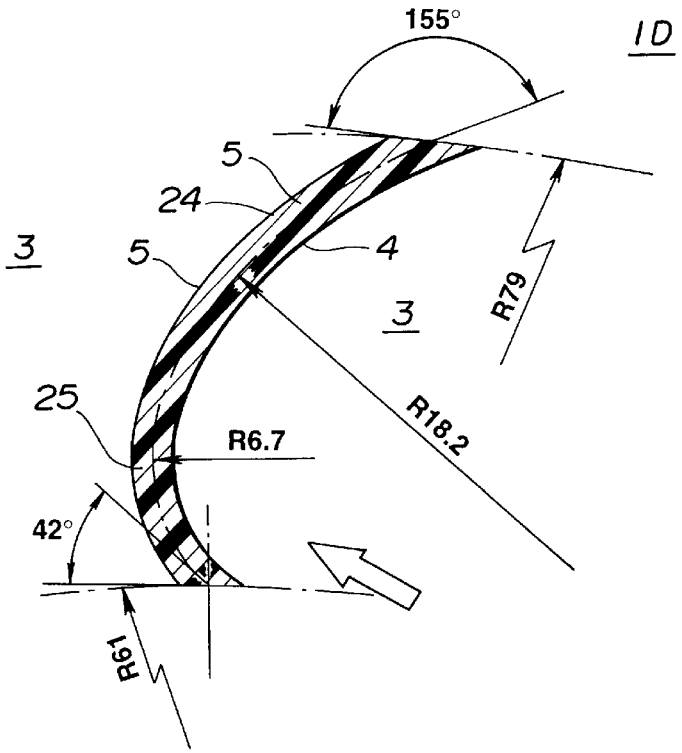
FIG. 8 is a partial sectional view of one of curved blades employed in a fan of a fourth embodiment of the invention.

Referring to FIG. 8, there is partially shown a centrifugal multiblade fan 1D which is a fourth embodiment of the present invention. In this embodiment, each curved blade 2 comprises a radially outside part 24 having a larger radius of curvature (for example, 18.2 mm) and a radially inside part 25 having a smaller radius of curvature (for example, 6.7 mm) which are united through a smoothly curved portion. With such shape of each blade 2, air can be smoothly led into the air flow passage 3 without making a marked collision against the front surface 4 of the blade 2.

Figure 9:
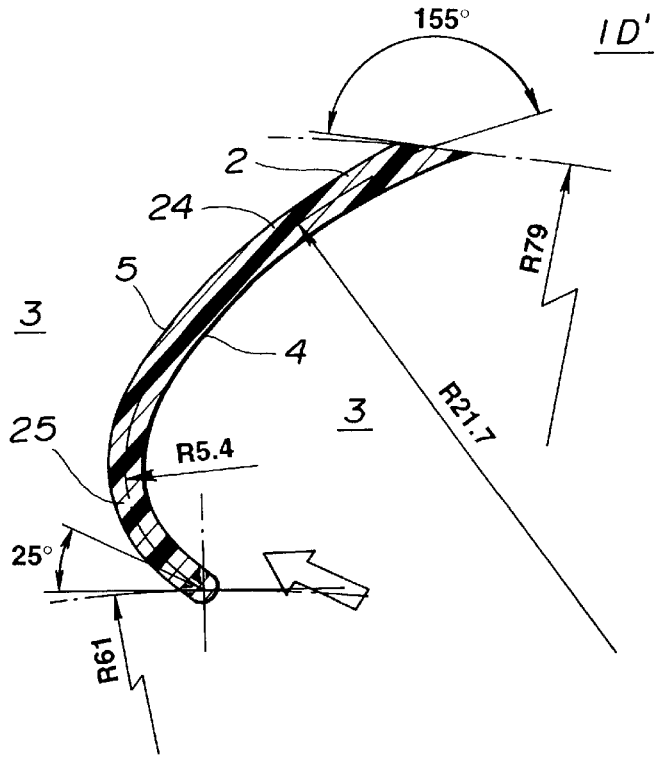
FIG. 9 is a view similar to FIG. 8, but showing a preferred example of the fourth embodiment.

Referring to FIG. 9, there is partially shown a centrifugal multiblade fan 1D' which is a modification of the fan 1D of FIG. 8. That is, in this modification, the radius of curvature of the radially outside part 24 of each blade 2 is 21.7 mm and that of the radially inside part 25 is 5.4 mm. The reason of the advantage possessed by the fans 1D and 1D' of FIGS. 8 and 9 will become apparent from the following.

Figure 10:
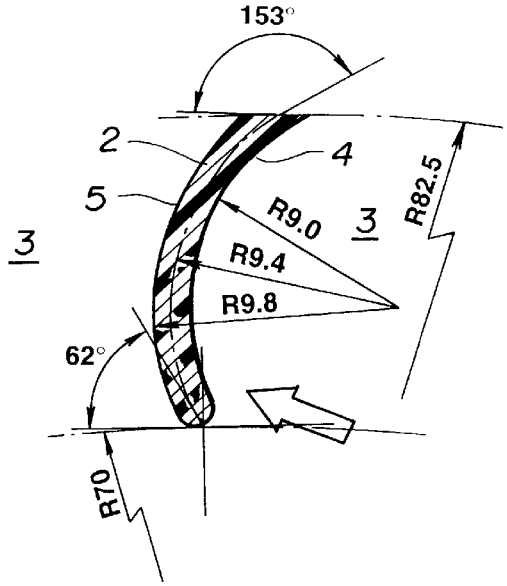
FIG.10 (PRIOR ART)
FIG. 10 is a partial sectional view of one of curved blades employed in the conventional centrifugal multiblade fan.

In FIG. 10, there is shown one of the curved blades 2 employed in a conventional centrifugal multiblade fan. In this blade 2, the radius of curvature of the radially outside part and that of the radially inside part are substantially the same, approximately 9.4 mm. The inclination angle of each blade 2 relative to an inscribed cylindrical surface is 62° which is relatively large. In this arrangement, air led to the air flow passage 3 is forced to collide hard against the concave front surface 4 of each blade 2, which brings about a marked operation loss of the fan.

Figure 11:
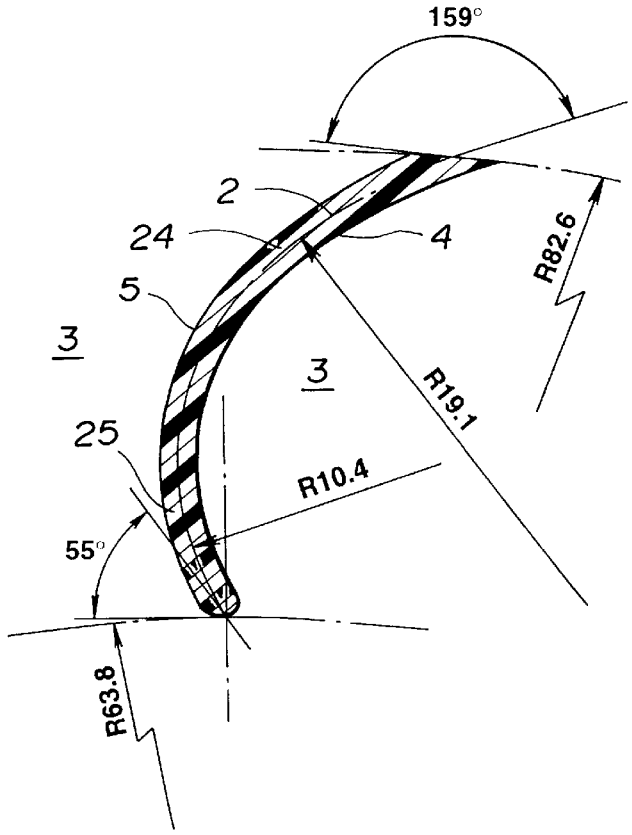
FIG.11 (PRIOR ART)
FIG. 11 is a view similar to FIG. 10, but showing another conventional centrifugal multiblade fan.

1 In FIG. 11, there is shown one of curved blades 2 employed in another conventional centrifugal multiblade fan. Each curved blade 2 comprises a radially outside part 24 having a larger radius of curvature (for example, 19.1 mm) and a radially inside part 25 having a smaller radius of curvature (for example, 10.4 mm) which are united through a smoothly curved portion. The inclination angle of each blade 2 relative to an inscribed cylindrical surface is 55° which is relatively large. Thus, the fan has the same drawback possessed by the fan of FIG. 10.

However, in case of the above-mentioned fans 1D and 1D' of FIGS. 8 and 9 according to the invention, the inclination angle of each blade 2 is only 42° or 25° which is very small. That is, for this reason, air can be smoothly led into the air flow passage 3 without making a hard collision against the front surface 4 of the blade 2.

When comparing the conventional fan of FIG. 10 to the fan 1D of FIG. 8, computer simulation tests have revealed that the static pressure increases from 333.9 (Pa) to 351.7 (Pa), the specific sound level decreases from 16.3 (dB-A) to 15.6 (dB-A) and the total pressure efficiency increases from 36.0% to 36.7%.

From various computer simulation tests, the applicants have found the following facts.

That is, if the inclination angle of each curved blade to the inscribed cylindrical surface is smaller than 50°, satisfactory operation is obtained from the fan. This advantageous fact also takes place irrespective of presence/absence of the slit 7.

Referring to FIGS. 12 to 21, there are partially shown other centrifugal multiblade fans 1E to 1L according to the present invention. These fans 1E to 1L satisfy the above-mentioned features of the present invention. It is further to be noted that these fans 1E to 1L can be injection molded by using a so-called axial draw type mold unit which is simple in construction as compared with a so-called radial draw type mold unit. That is, in the mold unit of axial type, paired molds are displaceable in an axial direction relative to each other.

Figure 12:
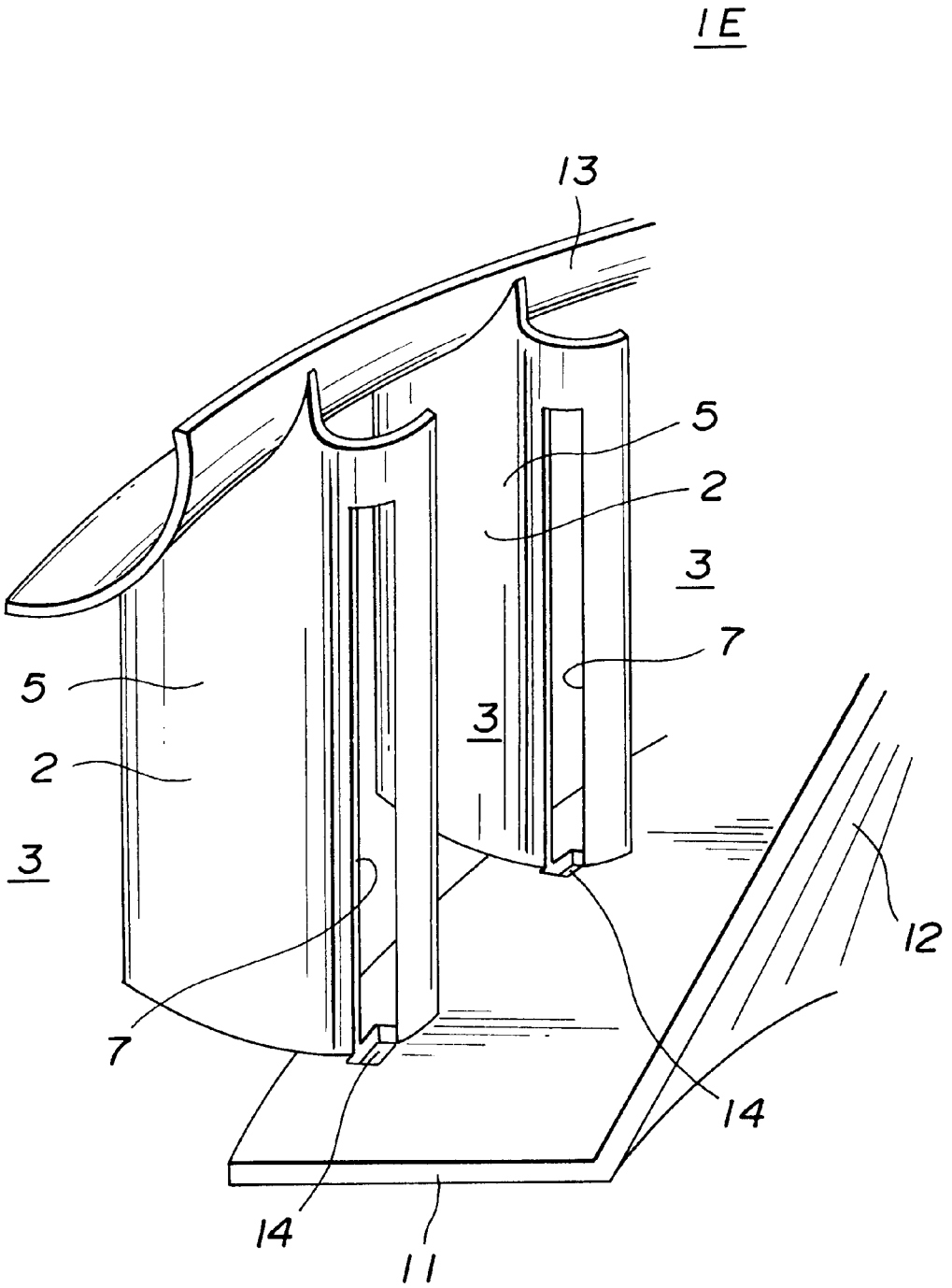
FIG. 12 is a partial perspective view of a centrifugal multiblade fan which is a fifth embodiment of the invention.

In the fan 1E of FIG. 12, there are employed first and second annular end plates 11 and 13 between which the circularly arranged curved blades 2 are sandwiched. Thus, the fan 1E has a robust structure. As shown, each blade 2 has a lower end whose radially inside part is integrally connected to a radially outside part of the first end plate 11 and has an upper end whose radially outside part is integrally connected to the second end plate 13. The first end plate 11 has a cone-shaped holder part 12 which is connected to an output shaft of an electric motor (not shown). As shown, an inner diameter of the second end plate 13 is greater than an outer diameter of the first end plate 11. With this, the first and second end plates 11 and 13 are not overlapped when viewed from an axial direction of the fan 1E. With this non-overlapped formation of the two end plates 11 and 13, the axial draw type mold unit can be used.

As shown, each curved blade 7 is formed with an elongate slit 7 at the radially inside part thereof. Each slit 7 is merged at a lower end thereof with a rectangular opening 14 formed in the first end plate 11. The size of the opening 14 is larger than the cross section area of the slit 7. It is to be noted that the openings 14 are the traces of spacers (not shown) of one mold which have been kept in the mold unit under injection molding.

Figure 13:
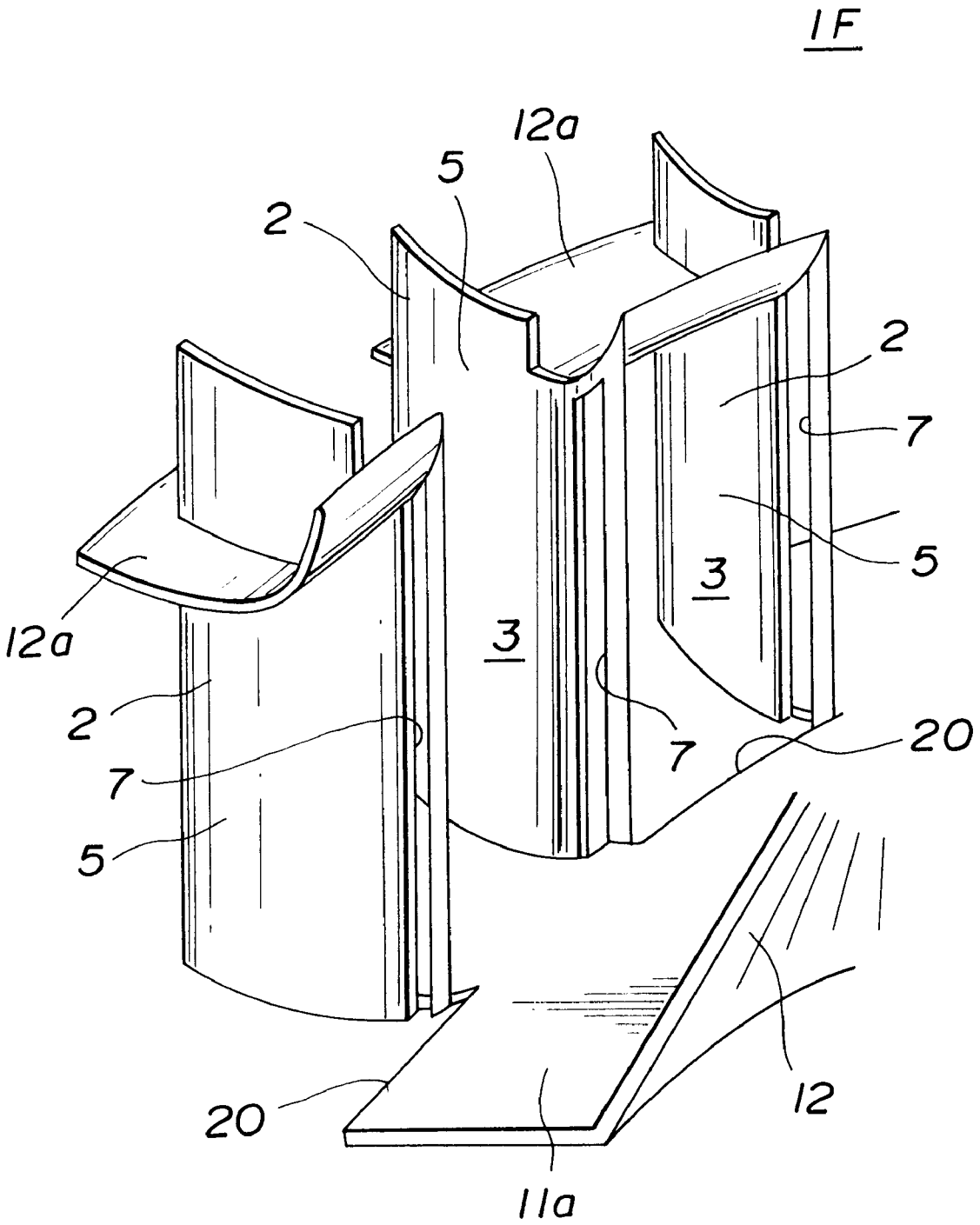
FIG. 13 is a view similar to FIG. 12, but showing a sixth embodiment of the invention.

In the fan 1F of FIG. 13, there is employed a first annular end plate 11*a* on which the circularly arranged curved blades 2 are put. The first end plate 11*a* has a cone-shaped holder part 12 which has an apertured center boss (not shown). Although not shown in the drawing, an output shaft of an electric motor is engaged with the boss to drive the fan 1F. As shown, every other two of the blades 2 have upper portions connected through a bridge 12*a* which has a curved radially inside portion. The first annular end plate 11*a* is formed at portions facing the bridges 12*a* with openings 20. Each curved blade 2 is formed with an elongate slit 7 at the radially inside part thereof. Each slit 7 is merged at a lower end thereof with the corresponding opening 20. Due to the shape of the fan 1F, injection molding of this fan 1F is relatively easy as compared with that of the above-mentioned fan 1E.

Figure 14:
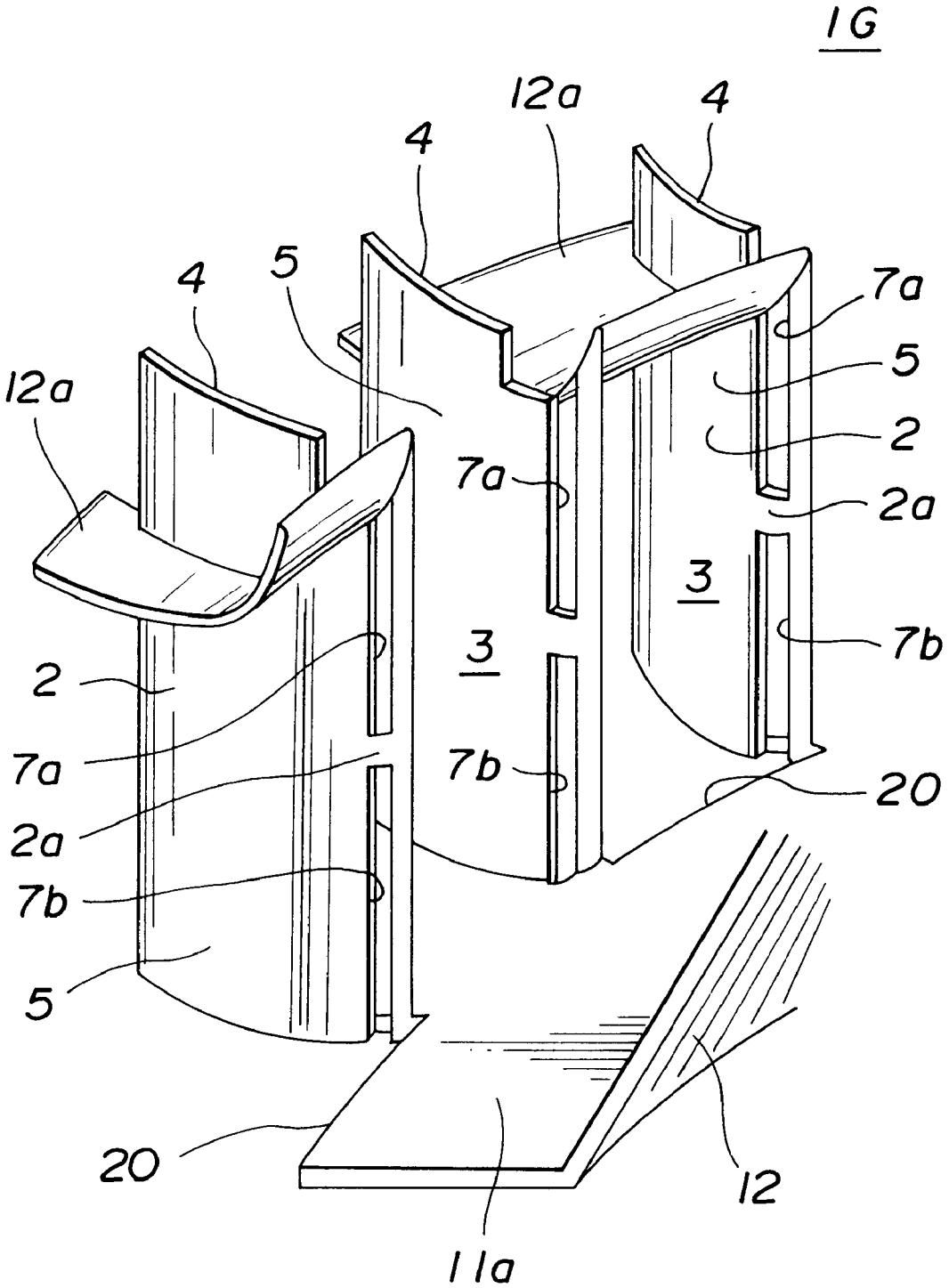
FIG. 14 is a view similar to FIG. 12, but showing a seventh embodiment of the invention.

The fan 1G of FIG. 14 is substantially the same as the fan 1F of FIG. 13 except for the following.

That is, in the fan 1G, in place of the slit 7, two slits 7*a* and 7*b* are formed in the radially inside part of each curved blade 2, which are aligned, as shown. That is, the two slits 7*a* and 7*b* are aligned leaving a bridge part 2*a* therebetween. Due to provision of the bridge part 2*a*, the mechanical strength of each blade 2 is increased as compared with that of the fan 1F.

Figure 15:
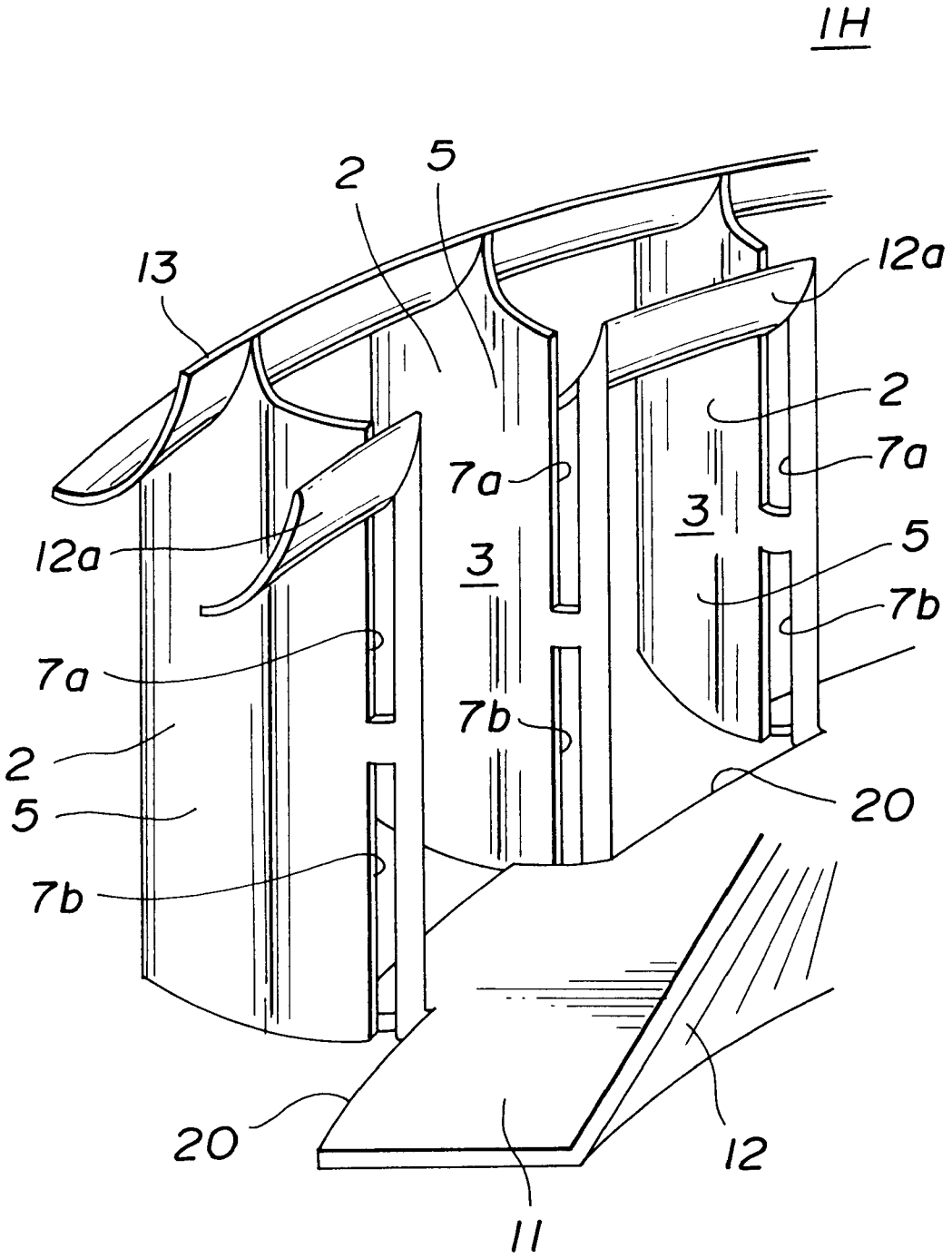
FIG. 15 is a view similar to FIG. 12, but showing an eighth embodiment of the invention.

The fan 1H of FIG. 15 is substantially the same as the fan 1G of FIG. 14 except for the following.

That is, in the fan 1H, there is further employed a second annular end plate 13 to which an upper end of each blade 2 is integrally connected, like in the manner as the fan 1E of FIG. 12.

Figure 16:
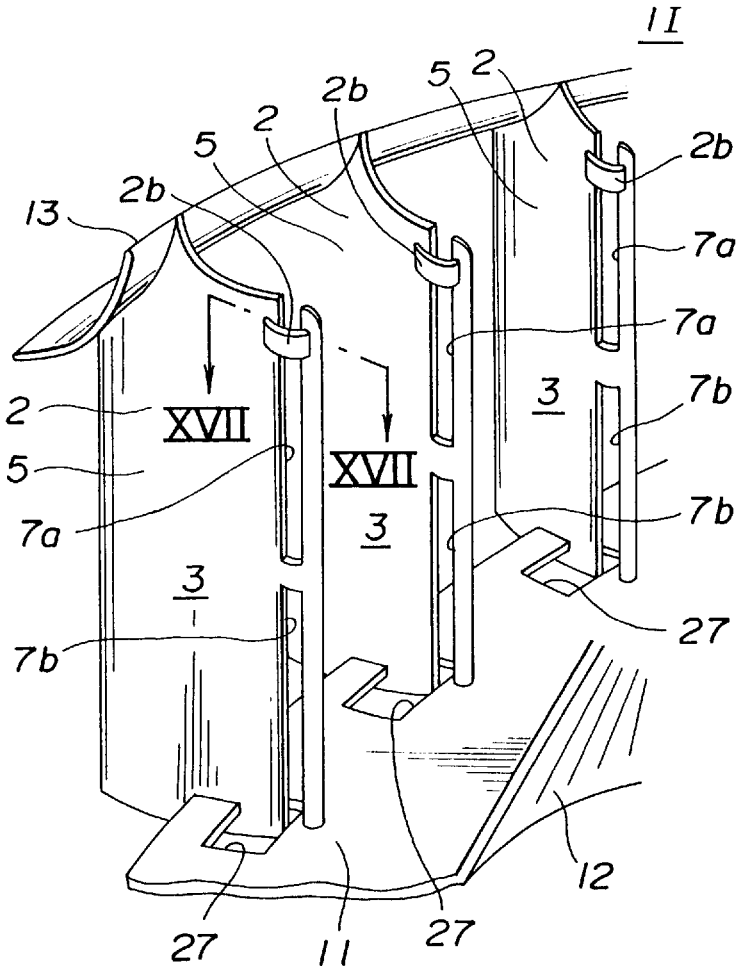
FIG. 16 is a view similar to FIG. 12, but showing a ninth embodiment of the invention.
Figure 17:
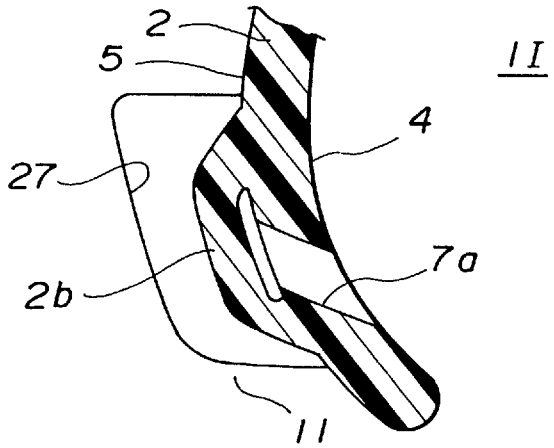
FIG. 17 is an enlarged sectional view taken along the line XVII—XVII of FIG. 16.

The fan 1I of FIGS. 16 and 17 is similar to the fan 1E of FIG. 12 except for the following. It is to be noted that FIG. 17 is an enlarged sectional view taken along the line XVII—XVII of FIG. 16.

That is, in the fan 1I of FIG. 16, in place of the slit 7, two slits 7*a* and 7*b* are formed in each curved blade 2. The upper slit 7*a* has an upper portion crossed by a raised bridge 2*b*. As shown, each raised bridge 2*b* is provided on the convex rear surface 5 of the blade 2. The first end plate 11 is formed at portions facing the raised bridges 2*b* with openings 27. That is, these openings 27 are exposed to the convex rear surfaces 5 of the blades 5. It is to be noted that the openings 27 are the traces of spacers (not shown) of one mold which have been kept in the mold unit under injection molding. Due to provision of the raised bridge 27, the mechanical strength of each blade 2 is increased.

Figure 18:
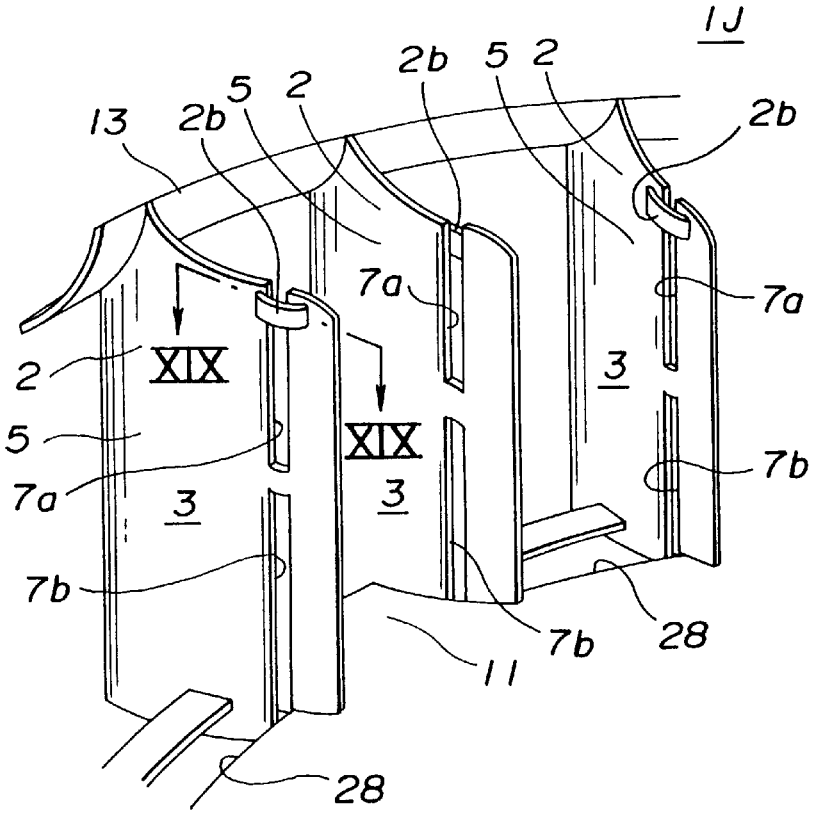
FIG. 18 is a view similar to FIG. 12, but showing a tenth embodiment of the invention.
Figure 19:
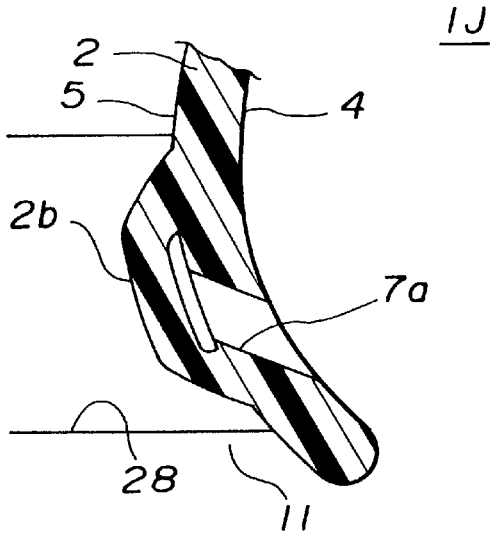
FIG. 19 is an enlarged sectional view taken along the line XIX—XIX of FIG. 18.

The fan 1J of FIGS. 18 and 19 is substantially the same as the fan 11 of FIGS. 16 and 17 except for the following. It is to be noted that FIG. 19 is an enlarged sectional view taken along the line XIX—XIX of FIG. 18.

That is, in the fan 1J of FIG. 18, half the number of the raised bridges 2*b* are provided at the concave front surfaces 5 of the blades 2. That is, the raised bridges 2*b* are provided at the rear and front surfaces 5 and 4 of the blades 2 alternatively. The first end plate 11 is formed at portions facing the raised bridges 2*b* with openings 28. Each opening 28 extends between adjacent two blades 2.

Figure 20:
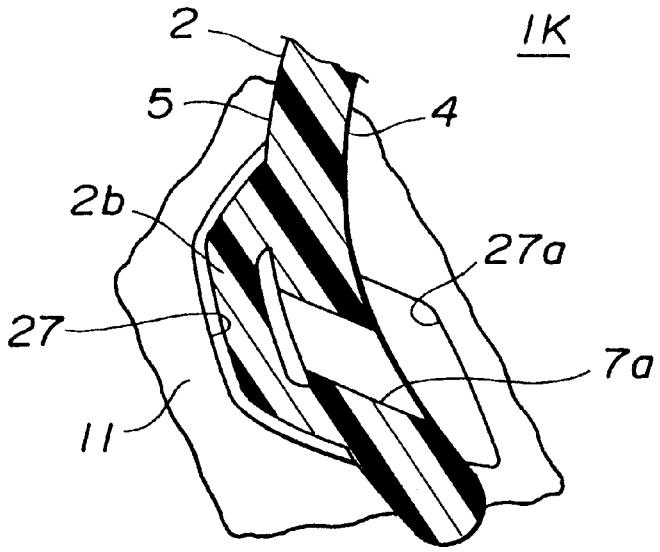
FIG. 20 is a view similar to FIG. 17, but showing an eleventh embodiment of the invention.

In FIG. 20, there is shown a raised bridge 2*b* employed in the fan 1K. The fan 1K is substantially the same as the fan 1H of FIGS. 16 and 17 except for the following.

As shown in FIG. 20, in the fan 1K, each opening 27 of the first end plate 11 extends to a portion 27*a* which is exposed to the concave front surface 4 of the blade 2.

Figure 21:
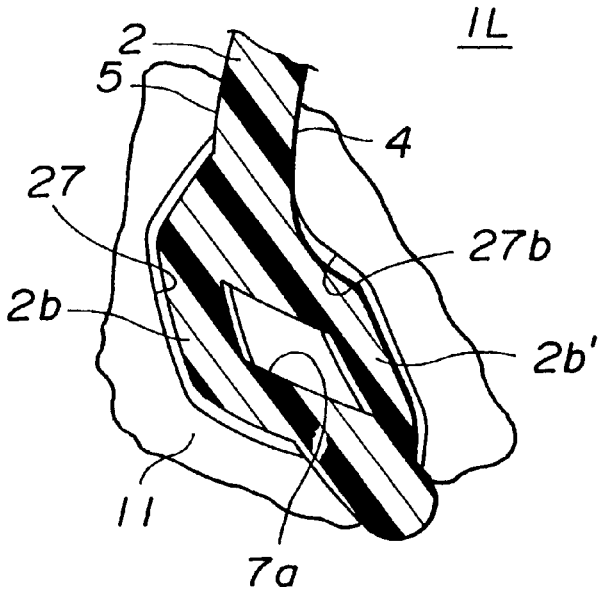
FIG. 21 is a view similar to FIG. 17, but showing a twelfth embodiment of the invention.

In FIG. 21, there is shown a bridge portion employed in the fan 1L. As is seen from this drawing, in the fan 1L, the bridge portion comprises a first raised bridge 2*b* formed on the rear surface 5 of each blade 2 and a second raised ridge 2*b*' formed on the front surface 4 of the blade 2. Each opening 27 of the first end plate 11 extends to a portion 27*b* which is exposed to the concave front surface 4 of the blade 2.

RESULTS OF PERFORMANCE TESTS

Figure 37:
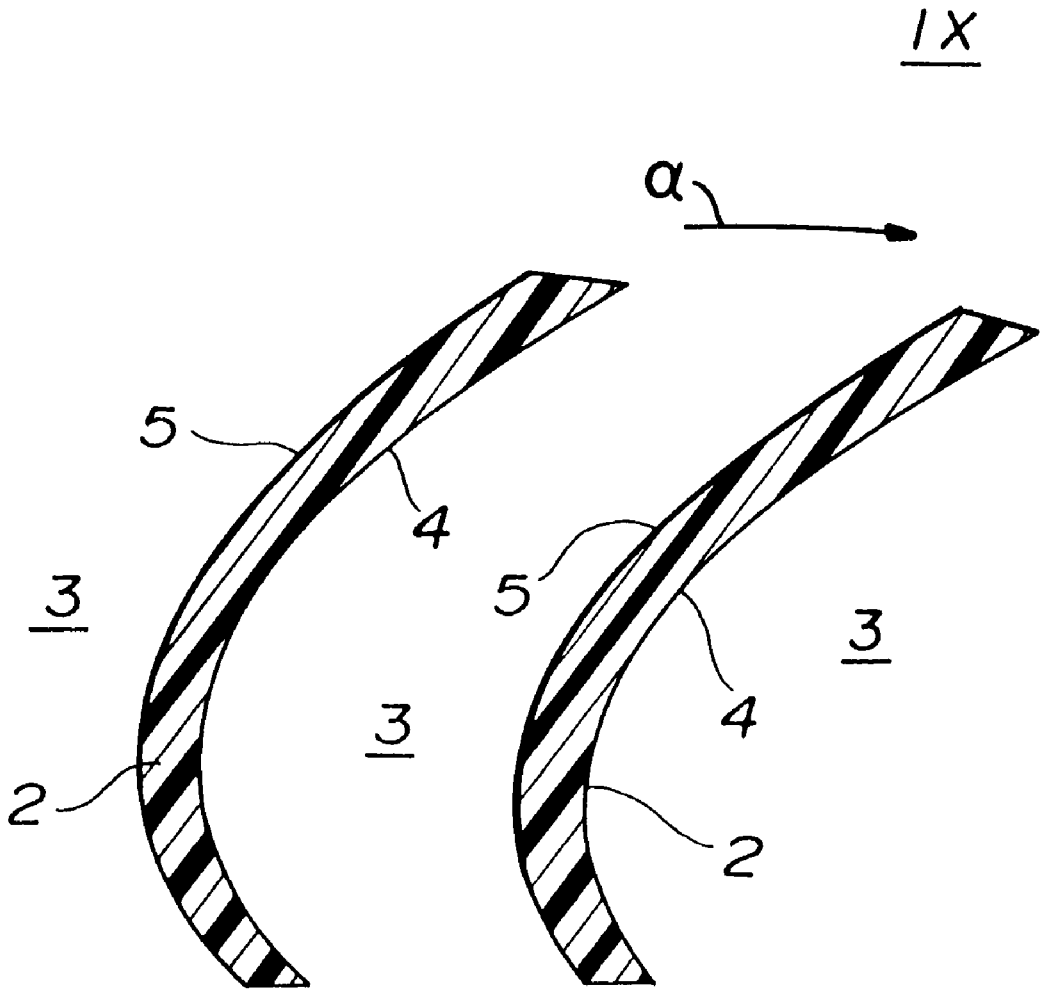
FIG. 37 is a sectional view of two curved blades employed in the fan of the present invention.

In order to examine the performance of the present invention, the following performance tests were carried out on the conventional fan of FIG. 35, the fan 1X of FIG. 37 according to the invention and the fan 1A of FIG. 1 according to the invention.

In the tests, each fan was turned with an electric motor at three speeds to produce three types of air capacities (or airflow) of 7 $m^3$/min, 8 $m^3$/min and 9 $m^3$/min, and the static pressure, input power (demand), efficiency, total pressure, noise level and specific sound level were measured in each air capacity. In all of the fans, the outer diameter was 158 mm, the axial length was 75 mm and the number of blades was 43. The electric motor used was of a 12V-DC motor producing 4.7 Kg.cm of torque at a rotational speed of 2955 rpm.

Figure 22:
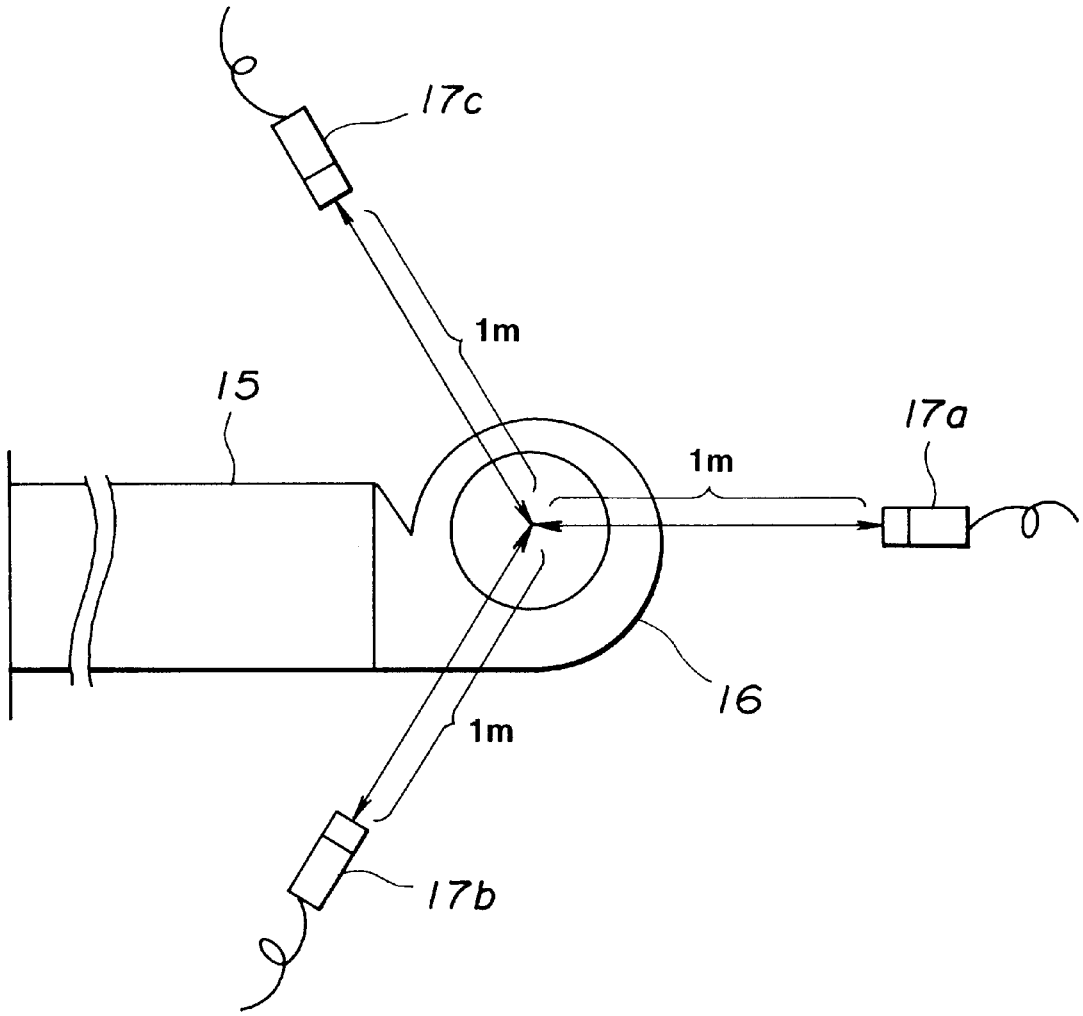
FIG. 22 is a view showing an arrangement of three microphones used for examining the sound-performance of the fans of the invention.

As is seen from FIG. 22, for examining the noise level and specific sound level, each fan was set in a blower case 16 connected to a duct 15 and three microphones 17*a*, 17*b* and 17*c* were arranged around the blower case 16 at evenly spaced intervals. The distance between the center of each fan and each microphone 17*a*, 17*b* or 17*c* was 1 m.

Figure 23:
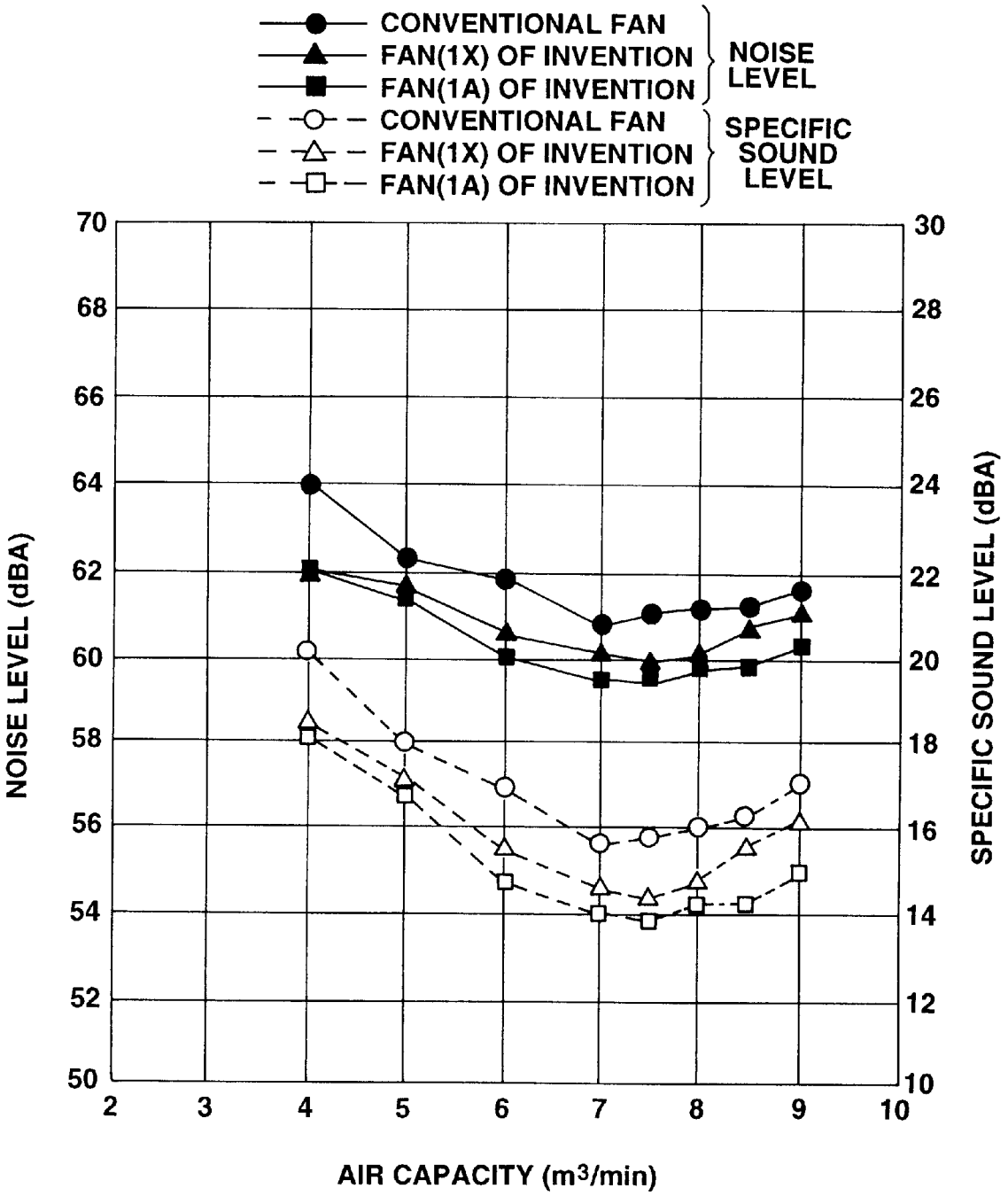
FIG. 23 is a graph showing the sound-performance of the invention and that of a conventional fan.

The results of the tests are shown in Tables 1 and 2 and the graph of FIG. 23.

From the results, the following facts were revealed.

(a) Performance of blower (static pressure)

As is seen from Table-1, the fans 1X and 1A of the inventions exhibited a slight improvement as compared with conventional one.

(b) Noise

As is seen from Table-2 and the graph of FIG. 23, the fans 1X and 1A of the invention exhibited an improvement of between 0.5 to 1.5 dB as compared with the conventional one. Regarding the specific sound level, the fans 1X and 1A of the invention exhibited an improvement of between 0.8 to 2.0 dB as compared with the conventional one. It is to be noted that the performance curves of the graph of FIG. 23 were drawn with reference to the average value of the noise levels.

Referring to FIGS. 24 to 32, there are shown other centrifugal multiblade fans 1M to 1R according to the present invention.

Figure 24:
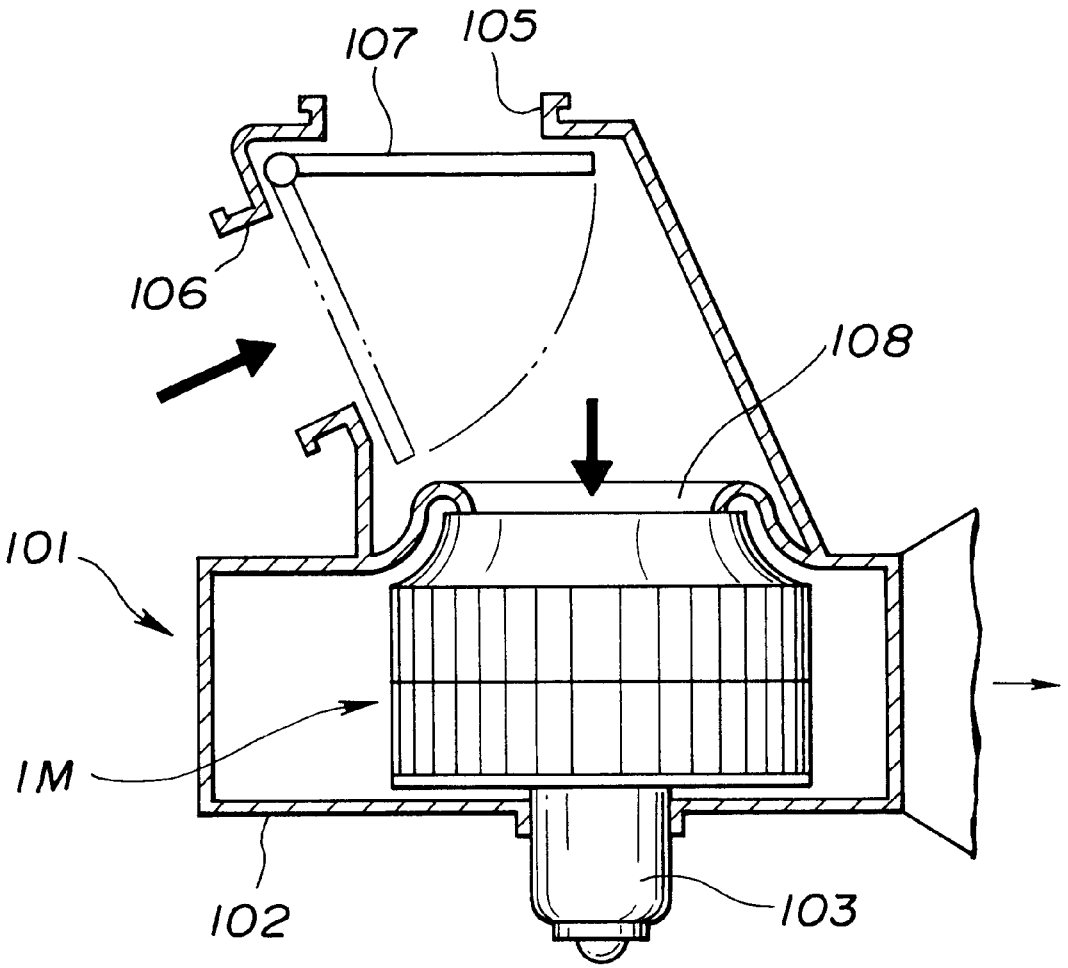
FIG. 24 is a sectional view of an air blower case in which a fan of a thirteenth embodiment of the invention is operatively installed.

In FIGS. 24 to FIG. 27C, there is shown the fan 1M which is a thirteenth embodiment of the invention. As shown in FIG. 24, in practical use, the fan 1M is installed in a case 102 of an air intake unit 101. The case 102 is formed with an outside air inlet opening 105 and an inside air inlet opening 106. These two openings 105 and 106 are selectively closed by an intake door 107. Within the case 102, there is defined a bell-mouth portion 108. Below the bell-mouth portion, the fan 1M is rotatably installed. Denoted by numeral 103 is an electric motor for driving the fan 1M. When, upon energization of the motor 103, the fan 1M is rotated in a given direction, air is led into the fan 1M and blown radially outward therefrom as is indicated by the arrows.

Figure 25:
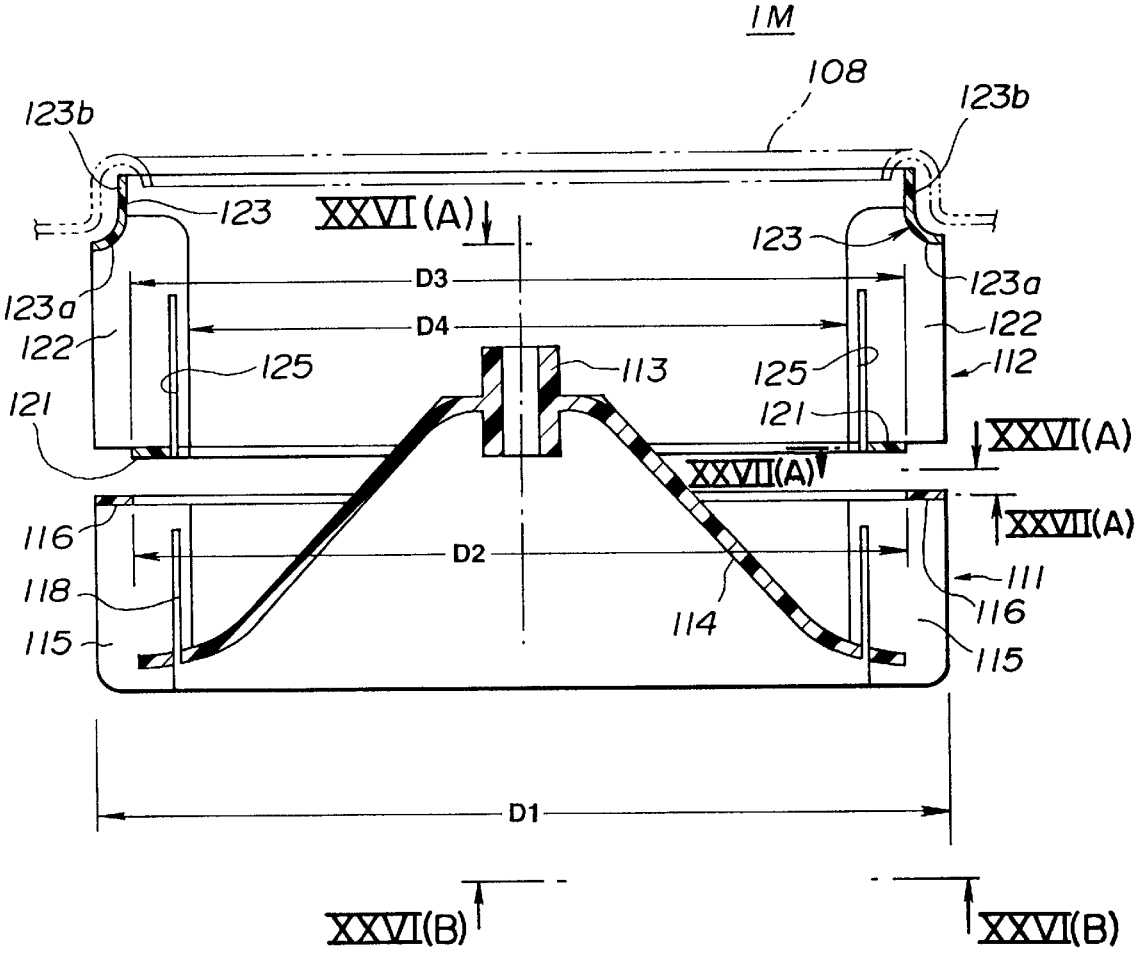
FIG. 25 is an enlarged sectional view of the fan of the thirteen embodiment of the invention, the fan shown being in a preassembled condition.

As is best shown in FIG. 25, the fan 1M comprises a first fan part 111 and a second fan part 112 which are coaxially coupled. It is to be noted that the fan 1M shown in FIG. 25 is in a condition before final assembly.

The first fan part 111 comprises a cone-shaped holder part 114 which has an apertured center boss 113. Although not shown in the drawing, an output shaft of the electric motor 103 is engaged with the apertured center boss 113 to drive the same.

Circularly arranged curved blades 115 are integrally formed on a peripheral portion of the holder part 114. That is, as is seen from FIGS. 26A and 26B, the curved blades 115 are circularly arranged about a common rotation axis at evenly spaced intervals and have such constructional features as has been described hereinabove. Each curved blade 115 is formed with a slit 118 in such a manner as has been mentioned hereinabove.

Figure 26B:
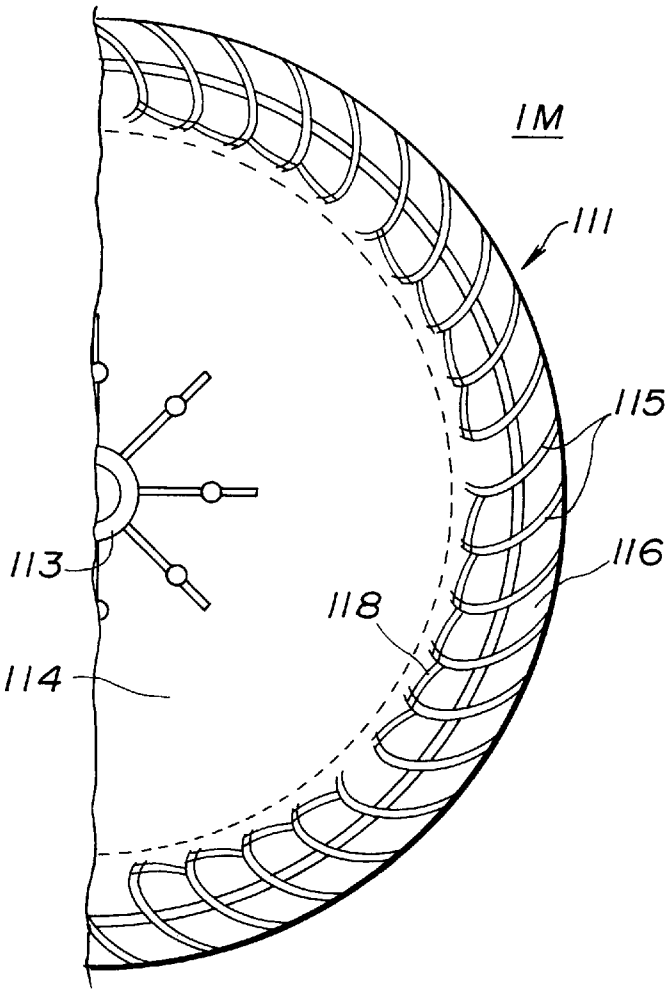
FIG. 26B is a sectional but half view taken along the line XXVI(B)—XXVI(B) of FIG. 25.
Figure 26A:
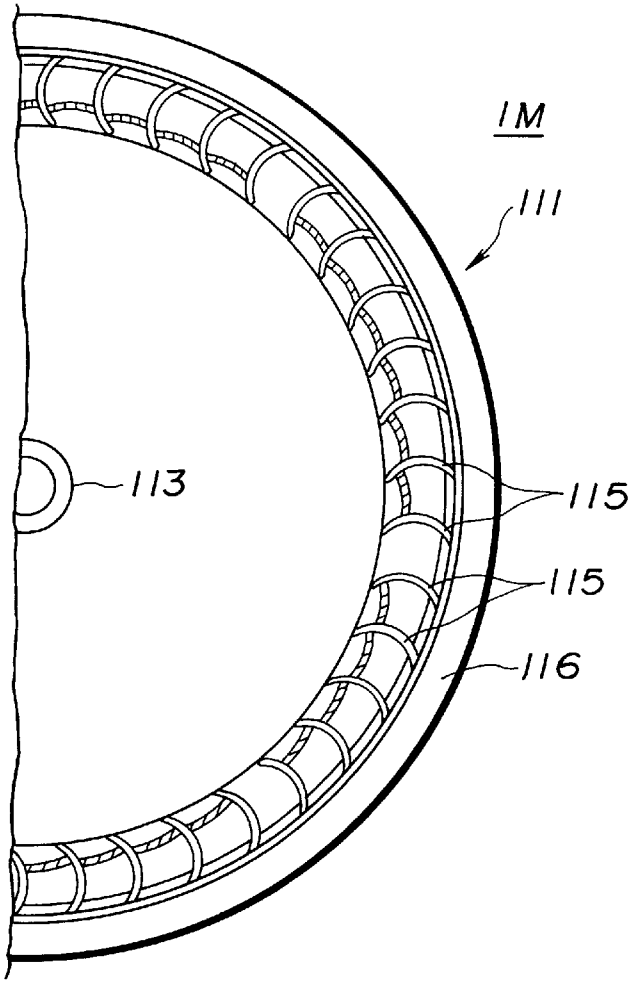
FIG. 26A is a sectional but half view taken along the line XXVI(A)—XXVI(A) of FIG. 25.

As is understood from FIGS. 25, 26A and 26B, an upper annular end plate 116 is put on and integral with upper ends of the blades 115. The outer diameter D1 of the annular end plate 116 is substantially the same as that of an imaginary circle defined by radially outer ends of the blades 115, while, the inner diameter D2 of the annular end plate 116 is substantially the same as or slightly larger than an outer diameter of cone-shaped holder part 114. With this shape, injection molding for the first fan part 111 is easily carried out through a simple mold unit.

As is seen from FIG. 25, the second fan part 112 comprises a lower annular end plate 121 on which circularly arranged curved blades 122 stand. That is, the curved blades 122 are circularly arranged about a common rotation axis at evenly spaced intervals and have such constructional features as has been described hereinabove. Each curved blade 122 is formed with a slit 125 in such a manner as has been mentioned hereinabove.

As is understood from FIG. 25, an upper annular end plate or shroud member 123 is put on and integral with upper ends of the blades 122. As shown, the end plate 123 comprises a skirt part 123*a* and a tubular part 123*b* which cooperates with the bell-mouth portion 108 of the case 102. The outer diameter D3 of the lower annular end plate 121 is substantially the same as or slightly smaller than the inner diameter D2 of the annular end plate 116 of the first fan part 111. That is, the second fan part 112 can be coaxially and snugly put on the first fan part 111 having the end plate 121 mated with the end plate 116. The inner diameter D4 of the end plate 121 is substantially the same as that of an imaginary circle defined by radially inner ends of the blades 122. With this shape, injection molding for the second fan part 112 is easily carried out through a simple mold unit.

Figure 27A:
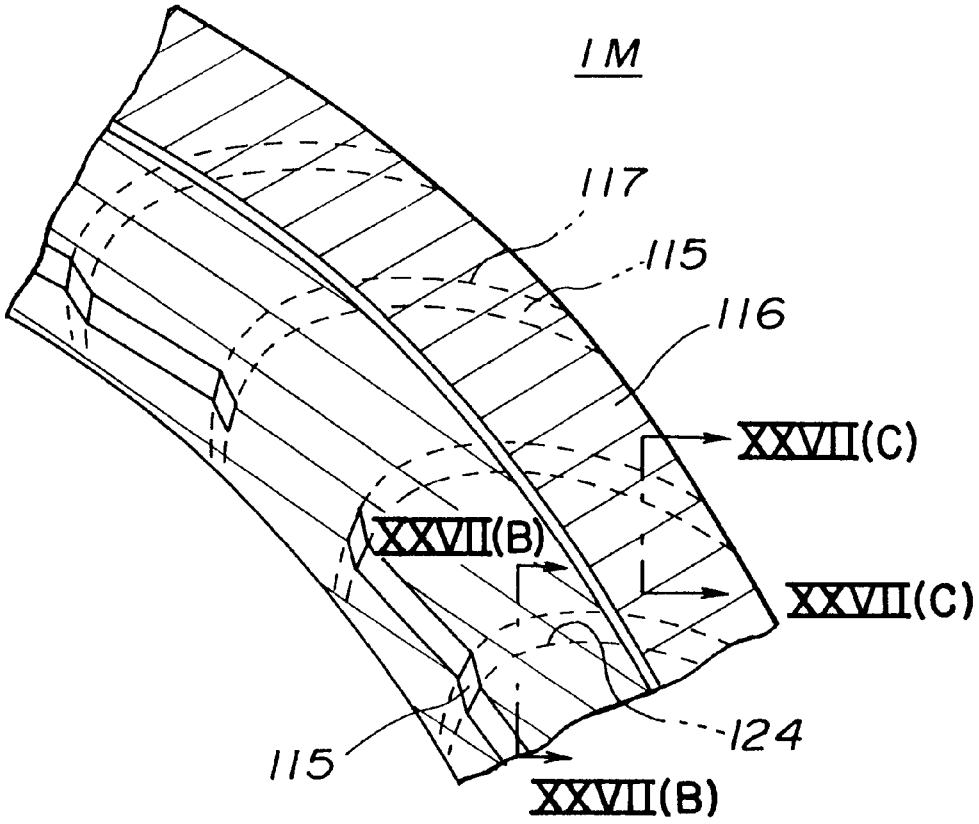
FIG. 27A is an enlarged sectional view taken along the line XXVII(A)—XXVII(A) of FIG. 25.
Figure 27B:
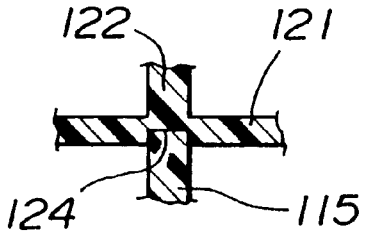
FIG. 27B is a sectional view taken along the line XXVII (B)—XXVII(B) of FIG. 27A.
Figure 27C:
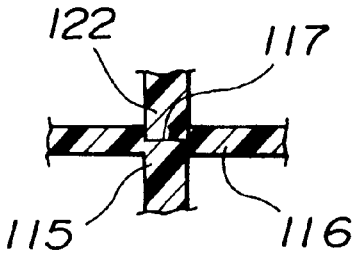
FIG. 27C is a sectional view taken along the line XXVII (C)—XXVII(C) of FIG. 27A.

The manner of coupling between the first and second fan parts 111 and 112 is shown in FIG. 27A which is an enlarged sectional view taken along the line XXVII(A)—XXVII(A) of FIG. 25. Sectional views taken along the line XXVII (B)—XXVII(B) and the line XXVII(C)—XXVII(C) of FIG. 27A are shown in FIGS. 27B and 27C respectively.

As is understood from these drawings, the annular end plate 116 of the first fan part 111 is formed at an outer side with a plurality of curved grooves 117, while the annular end plate 121 of the second fan part 112 is formed at an outer side with a plurality of curved grooves 124. That is, the curved grooves 117 of the end plate 116 receive lower ends of the curved blades 122 of the second fan part 112, and the curved grooves 124 of the end plate 121 receive upper ends of the curved blades 115 of the first fan part 111. By applying ultrasonic vibration to the mated portions between each blade 116 or 121 and the blades 122 or 115, the mated portions become united. Of course, adhesive may be used in place of such ultrasonic bonding.

With usage of the first and second fan parts 111 and 112, various types and sizes are available in the fan 1M of the thirteenth embodiment. That is, by changing the combination between the two fan parts 111 and 112, a fan having a desired shape and size is easily produced.

Figure 28:
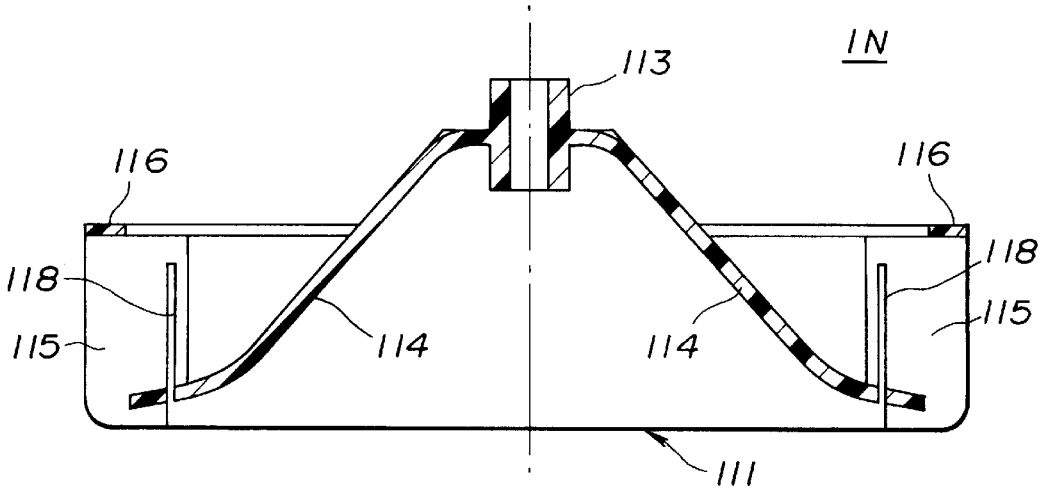
FIG. 28 is a sectional view of a centrifugal multiblade fan which is a fourteenth embodiment of the invention.

In FIG. 28, there is shown the fan 1N of a fourteenth embodiment of the invention. This fan 1N is the first fan part 111 of the fan 1M of the above-mentioned thirteenth embodiment.

Figure 29:
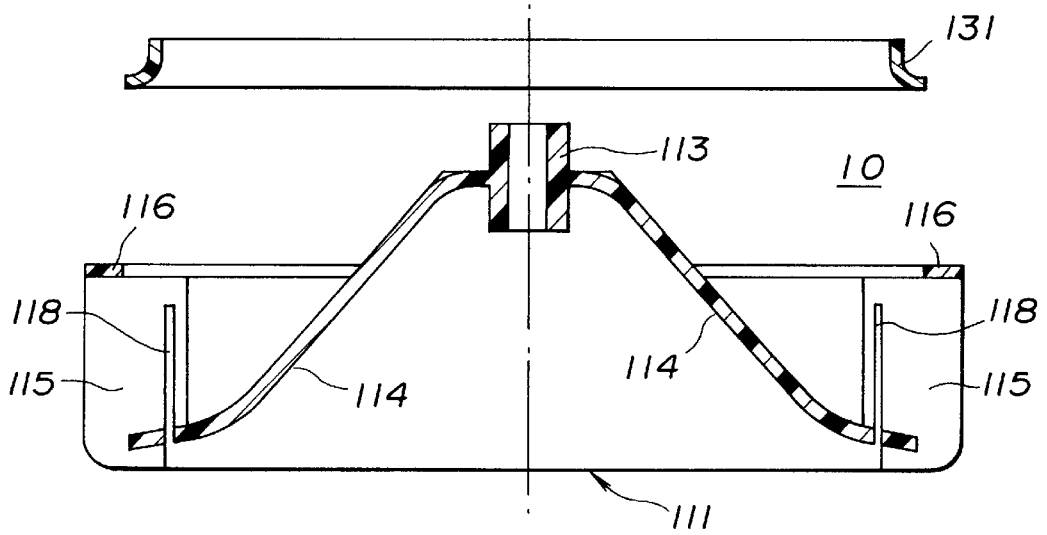
FIG. 29 is a view similar to FIG. 28, but showing a fifteenth embodiment of the invention.

In FIG. 29, there is shown the fan 1O of a fifteenth embodiment of the invention. The fan 1O shown is in a condition before final assembly. The fan 1O is substantially the same as the above-mentioned fan 1N except that in this fifteenth embodiment a shroud member 131 is employed. That is, the shroud member 131 is integrally connected to the annular end plate 116.

Figure 30:
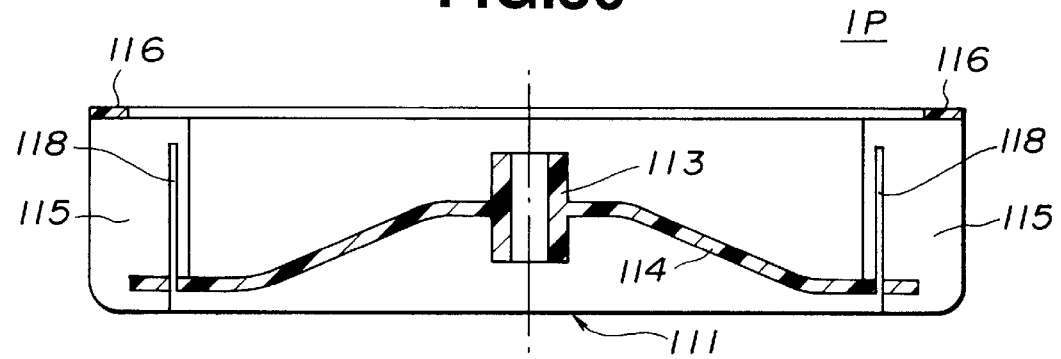
FIG. 30 is a view similar to FIG. 28, but showing a sixteenth embodiment of the invention.

In FIG. 30, there is shown the fan 1P of a sixteenth embodiment of the invention. This fan 1P is a modification of the above-mentioned fan 1N of FIG. 28. That is, as is seen from the drawing, the cone-shaped holder part 114 is shallower than that of the fan 1N, so that the apertured center boss 113 is positioned behind the end plate 116.

Figure 31:
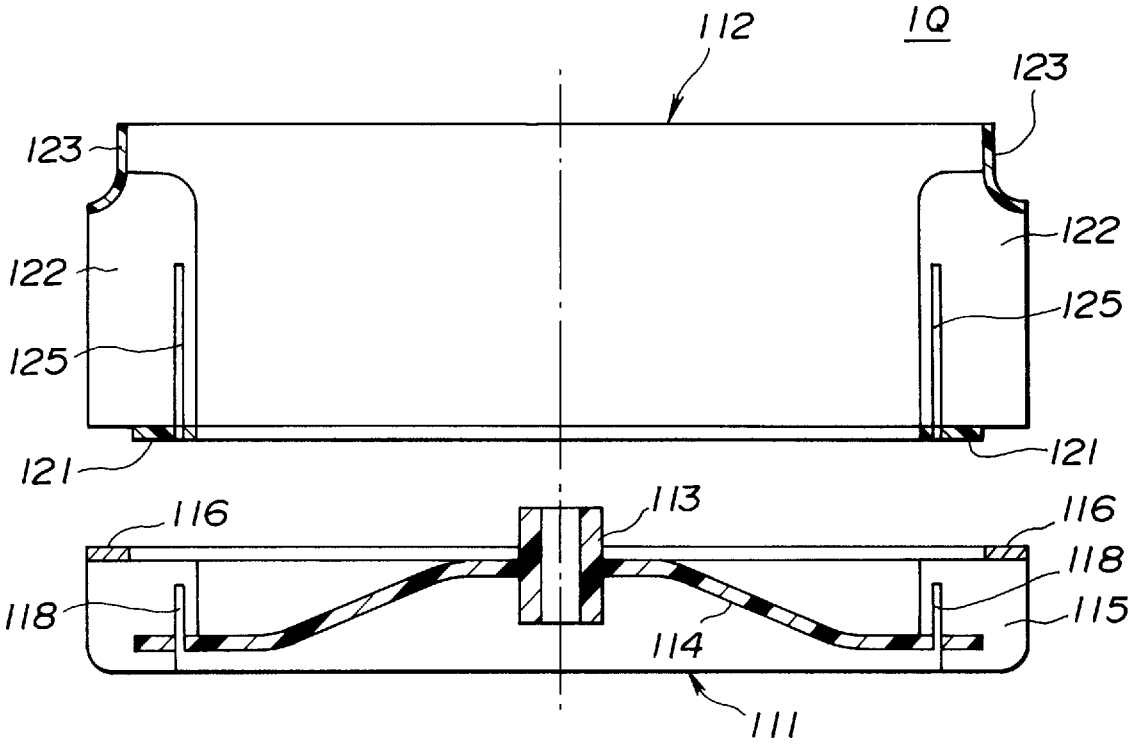
FIG. 31 is a view similar to FIG. 28, but showing a seventeenth embodiment of the invention.

In FIG. 31, there is shown the fan 1Q of a seventeenth embodiment of the invention. Similar to the fan 1M of FIG. 25, the fan 1Q of this embodiment comprises a first fan part 111 and a second fan part 112 which are coaxially coupled. It is to be noted that the fan 1Q shown in FIG. 31 is in a condition before final assembly.

The first fan part 111 of this fan 1Q is thinner than that of the fan 1M of FIG. 25, while the second part 112 is the same as that of the fan 1M.

Figure 32:
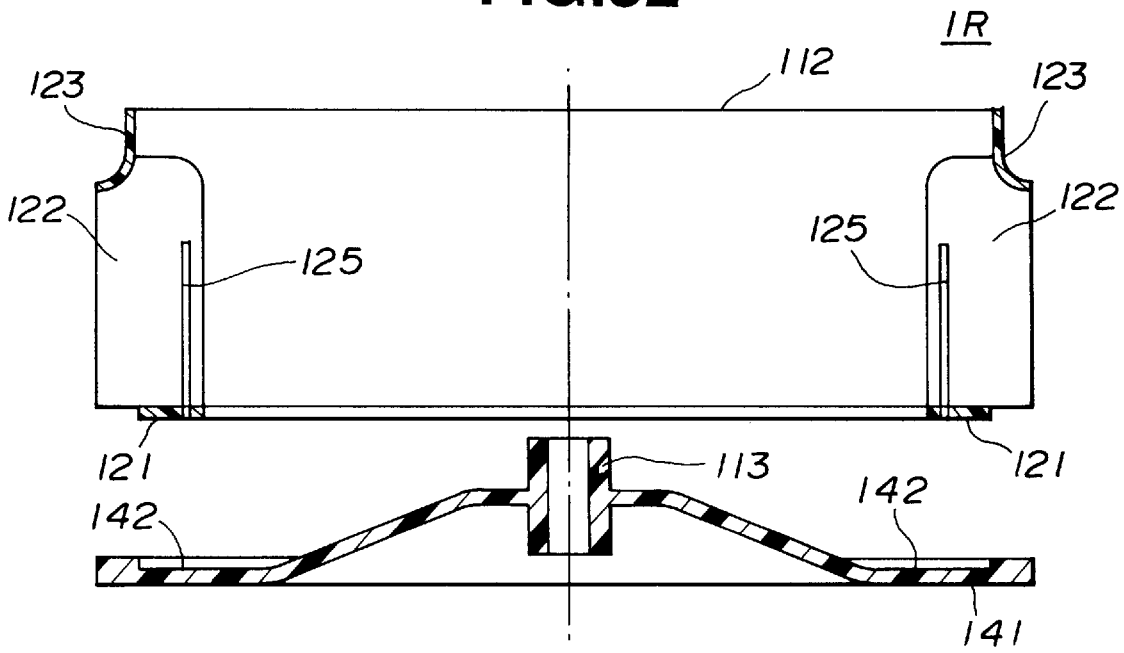
FIG. 32 is a view similar to FIG. 28, but showing an eighteenth embodiment of the invention.

In FIG. 32, there is shown the fan 1R of an eighteenth embodiment of the invention. As shown in the drawing, the fan 1R of this embodiment comprises a circular plate member 141 and a fan part 112 which is the same as that of the fan 1M of FIG. 25. The fan part 112 is coaxially put on and integral with the circular plate member 141. The circular plate member 141 is formed with an annular recess 142 into which the annular end plate 121 is snugly received.

TABLE 1

| AIR CAPACITY ($m^3$/min) ITEM | 7.0 STATIC PRESSURE (Pa) (mmAq) | 7.0 INPUT POWER (W) | 7.0 EFFICIENCY (%) | 8.0 STATIC PRESSURE (Pa) (mmAq) | 8.0 INPUT POWER (W) | 8.0 EFFICIENCY (%) | 9.0 STATIC PRESSURE (Pa) (mmAq) | 9.0 INPUT POWER (W) | 9.0 EFFICIENCY (%) |
|---|---|---|---|---|---|---|---|---|---|
| CONVENTIONAL FAN | 588<br>60.0 | 199 | 38.7 | 515<br>52.5 | 220 | 37.1 | 417<br>42.5 | 241 | 34.2 |
| FAN (1X) OF INVENTION | 613<br>62.5 | 204 | 39.6 | 530<br>54.0 | 226 | 38.0 | 436<br>44.5 | 249 | 35.0 |
| FAN (1A) OF INVENTION | 618<br>63.0 | 209 | 38.3 | 544<br>55.5 | 234 | 36.8 | 466<br>47.5 | 259 | 33.9 |

TABLE 2

| | AIR CAPACITY (Ga) | 7.00 ($m^3$/min) | | | | 8.00 ($m^3$/min) | | | | 9.00 ($m^3$/min) | | | |
|---|---|---|---|---|---|---|---|---|---|---|---|---|---|
| CONVENTIONAL FAN | STATIC PRESSURE (Ps) | 60.0 (mmAq) | | | | 52.5 (mmAq) | | | | 42.5 (mmAq) | | | |
| | TOTAL PRESSURE (Pt) | 68.4 (mmAq) | | | | 63.5 (mmAq) | | | | 56.4 (mmAq) | | | |
| | MIC. POSITION | 17a | 17b | 17c | AVERAGE | 17a | 17b | 17c | AVERAGE | 17a | 17b | 17c | AVERAGE |
| | NOISE LEVEL (dBA) | 59.84 | 60.23 | 62.00 | 60.80 | 60.17 | 60.43 | 62.30 | 61.08 | 60.17 | 61.28 | 62.91 | 61.60 |
| | SPECIFIC SOUND LEVEL (dBA) | 14.69 | 15.08 | 16.85 | 15.65 | 15.09 | 15.35 | 17.22 | 15.99 | 15.60 | 16.72 | 18.34 | 17.03 |
| FAN (1X) OF INVENTION | STATIC PRESSURE (Ps) | 62.5 (mmAq) | | | | 54.0 (mmAq) | | | | 44.5 (mmAq) | | | |
| | TOTAL PRESSURE (Pt) | 70.9 (mmAq) | | | | 65.0 (mmAq) | | | | 58.4 (mmAq) | | | |
| | MIC. POSITION | 17a | 17b | 17c | AVERAGE | 17a | 17b | 17c | AVERAGE | 17a | 17b | 17c | AVERAGE |
| | NOISE LEVEL (dBA) | 60.07 | 60.47 | 59.87 | 60.15 | 59.72 | 60.47 | 60.11 | 60.15 | 60.50 | 61.60 | 61.23 | 61.10 |
| | SPECIFIC SOUND LEVEL (dBA) | 14.61 | 15.01 | 14.40 | 14.68 | 14.44 | 15.11 | 14.39 | 14.82 | 15.63 | 16.73 | 16.26 | 16.23 |
| FAN (1A) OF INVENTION | STATIC PRESSURE (Ps) | 63.0 (mmAq) | | | | 55.5 (mmAq) | | | | 47.5 (mmAq) | | | |
| | TOTAL PRESSURE (Pt) | 71.4 (mmAq) | | | | 66.5 (mmAq) | | | | 61.4 (mmAq) | | | |
| | MIC. POSITION | 17a | 17b | 17c | AVERAGE | 17a | 17b | 17c | AVERAGE | 17a | 17b | 17c | AVERAGE |
| | NOISE LEVEL (dBA) | 59.54 | 59.54 | 59.43 | 59.50 | 59.33 | 59.92 | 59.90 | 59.73 | 59.74 | 60.27 | 90.80 | 60.29 |
| | SPECIFIC SOUND LEVEL (dBA) | 14.01 | 14.01 | 13.91 | 13.98 | 13.85 | 14.43 | 14.42 | 14.24 | 14.43 | 14.97 | 15.50 | 14.99 |

What is claimed is:

1. A centrifugal multiblade fan, comprising:

a plurality of curved blades which are circularly arranged about a common rotation axis at evenly spaced intervals defining a curved air flow passage between neighboring blades, each curved blade having concave front and convex rear surfaces which extend longitudinally in parallel with the rotation axis;

a lower annular end plate for connecting lower ends of the circularly arranged blades; and a slit extending in parallel with the rotation axis along the radially inside part of each curved blade, each of said slits having an inclination angle defined by a radially outer wall of said slit that is greater than that of a radially inner wall of said slit;

wherein a radially outside part of each curved blade has a radius of curvature which is greater than that of a radially inside part of the blade.

2. A centrifugal multiblade fan as claimed in claim 1, wherein a ratio of a distance between the rotation axis of the fan and a radially outermost end of said radially inner wall of the slit to a radius of an inscribed cylindrical surface from which each curved blade extends radially outward is no greater than 1.08.

3. A centrifugal multiblade fan comprising:

a plurality of curved blades which are circularly arranged about a common rotation axis at evenly spaced intervals defining a curved air flow passage between neighboring blades, each curved blade having concave front and convex rear surfaces which extend longitudinally in parallel with the rotation axis, a radially outside part of each curved blade having a radius of curvature which is greater than that of a radially inside part of the blade;

means defining an axially extending slit in said radially inside part of each blade; and a lower annular end plate for putting thereon lower ends of the circularly arranged blades, wherein each slit curves radially outward as it extends in the curved blade from the concave front surface to the convex rear surface, wherein the thickness of each slit increases gradually with increase of distance from the concave front surface, and wherein an inclination angle defined by an upper wall of the slit is greater than that of a lower wall of the slit.

4. A centrifugal multiblade fan rotatable on an axis, the centrifugal multiblade fan comprising:

a lower annular end plate concentrically located around the rotation axis;

a plurality of curved blades mounted on said lower annular end plate around the rotation axis at evenly spaced intervals, each curved blade extending parallel to the rotation axis and having an arcuate cross-section lying in an imaginary plane perpendicular to the rotation axis, each curved blade having a concave front surface and a convex rear surface, and every two neighboring curved blades defining therebetween a curved air flow passage having a width defined between respective confronting concave and convex surfaces; and an elongated slit at a radially inner position of each of said plurality of curved blades, each of said elongated slits extending parallel to the rotation axis and having an inclination angle defined by a radially outer wall of said slit that is greater than that of a radially inner wall of said slit, and having a width that is between 1/5 and 1/20 of said width between the confronting concave and convex surfaces at said radially inner position, wherein said concave front surface faces forward when the fan rotates in a normal direction, and wherein a radially outside part of each curved blade has a radius of curvature which is greater than that of a radially inside part of the blade.

5. A centrifugal multiblade fan as claimed in claim 3, in which the slit curves radially outward as it extends in the curved blade from the concave front surface to the convex rear surface.

6. A centrifugal multiblade fan as claimed in claim 5, in which a first angle between an imaginary plane evenly passing through the slit and a tangent to an imaginary cylindrical surface coaxially extending around the rotation axis is between 90° and 180°.

7. A centrifugal multiblade fan as claimed in claim 4, in which the radially inside part of each curved blade is displaced rearward by a given degree with respect to the radially outside part.

8. A centrifugal multiblade fan as claimed in claim 4, in which the width of each slit increases gradually from the concave front surface to the convex rear surface of the curved blade.

9. A centrifugal multiblade fan as claimed in claim 8, in which the radially outer and radially inner walls of each slit are chamfered at their rear ends.

10. A centrifugal multiblade fan as claimed in claim 9, in which the radially outer and radially inner walls of each slit are chamfered at their front ends.

11. A centrifugal multiblade fan as claimed in claim 9, in which each blade has a tapered radial inner end.

12. A centrifugal multiblade fan as claimed in claim 4, in which an inclination angle of the radially inside part of each curved blade relative to a tangent of an imaginary cylindrical surface from which each curved blade extends radially outward is 42° or 25°.

13. A centrifugal multiblade fan as claimed in claim 4, further comprising:

an upper annular end plate being connected to upper ends of the circularly arranged curved blades that are opposite said lower annular end plate.

14. A centrifugal multiblade fan as claimed in claim 13, in which each curved blade has a lower end whose radially inside part is integrally connected to a radially outside part of the lower annular end plate, and the upper ends of the blades are integrally connected to the upper end plate.

15. A centrifugal multiblade fan as claimed in claim 14, in which said lower annular end plate is formed with a cone-shaped holder part which is adapted to be connected to an output shaft of an electric motor.

16. A centrifugal multiblade fan as claimed in claim 15, in which an inner diameter of the upper annular end plate is greater than an outer diameter of the lower annular end plate.

17. A centrifugal multiblade fan as claimed in claim 16, in which the slit is merged at a lower end thereof with a rectangular opening formed in the lower annular end plate, the size of the rectangular opening being larger than the cross section area of the slit.

18. A centrifugal multiblade fan as claimed in claim 17, in which each slit comprises lower and upper slit parts which are aligned and separated by a bridge portion formed by the curved blade, in which the upper slit part has an upper portion crossed by a raised bridge formed by the curved blade, and in which said lower annular end plate is formed with openings at portions corresponding to the raised bridges.

19. A centrifugal multiblade fan as claimed in claim 18, in which said raised bridge is provided at the convex rear surface of each blade.

20. A centrifugal multiblade fan as claimed in claim 18, in which half of the raised bridges are provided at the concave front surfaces of the curved blades.

21. A centrifugal multiblade fan as claimed in claim 18, in which each of the openings formed in the lower annular end plate extends between a rear side exposed to the convex rear surface of the curved blade and a front side exposed to the concave front surface of the curved blade.

22. A centrifugal multiblade fan as claimed in claim 21, in which each raised bridge comprises a first raised part formed on the convex rear surface of the curved blade and a second raised part formed on the concave front surface of the curved blade.

23. A centrifugal multiblade fan as claimed in claim 4, in which every other two of the curved blades have upper ends connected by respective bridges having a curved inside portion, and in which the lower annular end plate is formed with openings at portions corresponding to the bridges.

24. A centrifugal multiblade fan as claimed in claim 23, in which the slit of each curved blade comprises two slit parts which are aligned and separated by a bridge part formed by the curved blade.

25. A centrifugal multiblade fan as claimed in claim 24, further comprises an upper annular end plate to which upper ends of the circularly arranged curved blades are integrally connected.

26. A centrifugal multiblade fan as claimed in claim 4, in which said lower annular end plate is formed with a cone-shaped holder part which is adapted to be connected to an output shaft of an electric motor.

27. A centrifugal multiblade fan as claimed in claim 26, in which said cone-shaped holder part is formed with an apertured center boss to which said output shaft of the motor is mated.

28. A centrifugal multiblade fan as claimed in claim 27, in which said apertured center boss is axially projected outward with respect to the lower ends of the circularly arranged curved blades.

29. A centrifugal multiblade fan as claimed in claim 28, in which a shroud member is integrally connected to the lower annular end plate.

30. A centrifugal multiblade fan as claimed in claim 27, in which the apertured center boss is positioned behind the annular end plate.

31. A centrifugal multiblade fan as claimed in claim 4, in which said fan comprises:

a first fan part including a first group of the curved blades and a first annular end plate to which upper ends of the first group of the blades are integrally connected; and a second fan part including a second group of the curved blades and a second annular end plate to which lower ends of the second group of the blades are integrally connected, wherein said first and second fan parts are coaxially and integrally connected to each other in such a manner that the first and second annular end plates are coaxially coupled.

32. A centrifugal multiblade fan as claimed in claim 31, in which said second annular end plate is snugly received in said first annular end plate.

33. A centrifugal multiblade fan as claimed in claim 32, in which said first annular end plate is formed with a plurality of curved grooves into which the lower ends of the second group of the blades are received and in which said second annular end plate is formed with a plurality of curved grooves into which the upper ends of the first group of the blades are received.

34. A centrifugal multiblade fan as claimed in claim 33, in which the first annular end plate and the lower second group of the blades are integrally connected through a ultrasonic bonding process and the second annular end plate and the first group of the blades are integrally connected through a ultrasonic bonding process.

35. A centrifugal multiblade fan as claimed in claim 4, further comprising:

a circular plate member having a cone-shaped holder part; and a fan part including the circularly arranged curved blades and the lower annular end plate, said fan part being coaxially put on and integrally connected to the circular plate member.

36. A centrifugal multiblade fan as claimed in claim 35, in which said circular plate member is formed with an annular recess into which the lower annular plate is snugly received.

37. A centrifugal multiblade fan rotatable on an axis, the centrifugal multiblade fan comprising:

a lower annular end plate concentrically located around the rotation axis;

a plurality of curved blades mounted on said lower annular end plate around the rotation axis at evenly spaced intervals, each curved blade extending parallel to the rotation axis and having an arcuate cross-section lying in an imaginary plane perpendicular to the rotation axis, each curved blade having a concave front surface and a convex rear surface, and every two neighboring curved blades defining therebetween a curved air flow passage having a width defined between respective confronting concave and convex surfaces; and an elongated slit at a radially inner position of each of said plurality of curved blades, each of said elongated slits extending parallel to the rotation axis and having a width that is between 1/5 and 1/20 of said width between the confronting concave and convex surfaces at said radially inner position, wherein said concave front surface faces forward when the fan rotates in a normal direction, wherein a radially outside part of each curved blade has a greater radius of curvature than that of a radially inside part of the blade, wherein the slit curves radially outwardly as it extends in the curved blade from the concave front surface to the convex rear surface, wherein a first angle between an imaginary plane evenly passing through the slit and a tangent to an imaginary cylindrical surface coaxially extending around the rotation axis is between 90° and 180°, and wherein the first angle is equal to $\pi-\tan^{-1}(U/V)$, where U represents the radial velocity of air led into the air flow passage and V represents the rotation direction velocity of air flowing in the air flow passage near the slit.

38. A centrifugal multiblade fan as claimed in claim 37, in which the first angle is about 100° to about 160°.

* * * * *